US009612553B2

(12) United States Patent
Shimizu

(10) Patent No.: US 9,612,553 B2
(45) Date of Patent: Apr. 4, 2017

(54) CARTRIDGE HAVING AGITATOR AND ROTARY MEMBER WITH DETECTED PORTION

(71) Applicant: Brother Kogyo Kabushiki Kaisha, Nagoya-shi, Aichi-ken (JP)

(72) Inventor: Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/529,221

(22) Filed: Oct. 31, 2014

(65) Prior Publication Data

US 2015/0117905 A1 Apr. 30, 2015

(30) Foreign Application Priority Data

Oct. 31, 2013 (JP) ..... 2013-227251

(51) Int. Cl.
*G03G 15/08* (2006.01)

(52) U.S. Cl.
CPC ..... *G03G 15/0889* (2013.01)

(58) Field of Classification Search
CPC combination set(s) only.
See application file for complete search history.

(56) References Cited

U.S. PATENT DOCUMENTS 4,974,020 A 11/1990 Takamatsu et al.
5,053,816 A 10/1991 Takahashi
5,489,976 A 2/1996 Ichikawa
5,495,323 A 2/1996 Meetze, Jr.
5,495,327 A 2/1996 Inomata
5,640,651 A 6/1997 Katoh et al.
5,649,264 A 7/1997 Domon et al.
5,970,293 A 10/1999 Huang
(Continued)

FOREIGN PATENT DOCUMENTS

AU 2010281279 B2 2/2014
CN 1445624 A 10/2003
(Continued)

OTHER PUBLICATIONS

Apr. 26, 2011—(WO) International Search Report (JPO)—App PCT/JP2011/057946.
(Continued)

*Primary Examiner* — Clayton E Laballe
*Assistant Examiner* — Jas Sanghera
(74) *Attorney, Agent, or Firm* — Banner & Witcoff, Ltd.

(57) ABSTRACT

A cartridge includes a housing, an agitator, a first rotary member having a detected portion and a first abutment portion, and a second rotary member having a second abutment portion. The agitator includes: a rotation shaft having an axial end portion at which the second rotary member is supported; and an agitation blade supported to the rotation shaft and resiliently deformable. The second rotary member is configured such that while the agitation blade is being spaced apart from the housing, the second abutment portion contacts the first abutment portion in accordance with rotation of the second rotary member to move the first rotary member from the first position to the second position, thereby transmitting the driving force from the second rotary member to the first rotary member.

8 Claims, 16 Drawing Sheets

(56) References Cited

U.S. PATENT DOCUMENTS

| | | | |
|---|---|---|---|
| 6,088,561 | A | 7/2000 | Kawamura et al. |
| 6,154,619 | A | 11/2000 | Boockholdt et al. |
| 6,714,224 | B2 | 3/2004 | Yamanaka et al. |
| 6,792,217 | B2 | 9/2004 | Nishino et al. |
| 6,823,160 | B2 | 11/2004 | Okabe |
| 6,829,465 | B2 | 12/2004 | Yamanaka et al. |
| 6,903,759 | B2 | 6/2005 | Yamanaka et al. |
| 6,909,866 | B2 | 6/2005 | Kawai |
| 6,920,303 | B2 | 7/2005 | Yamanaka et al. |
| 7,116,919 | B2 | 10/2006 | Ishii |
| 7,130,551 | B2 | 10/2006 | Kobayashi |
| 7,418,214 | B2 | 8/2008 | Yoshida et al. |
| 7,463,834 | B2 | 12/2008 | Takagi et al. |
| 7,509,075 | B2 | 3/2009 | Hayakawa |
| 7,512,347 | B2 | 3/2009 | Suzuki et al. |
| 7,536,117 | B2 | 5/2009 | Kishi |
| 7,613,414 | B2 | 11/2009 | Kamimura |
| 7,643,777 | B2 | 1/2010 | Matsumoto et al. |
| 7,756,426 | B2 | 7/2010 | Kamimura |
| 7,933,536 | B2 | 4/2011 | Ogawa |
| 7,953,330 | B2 | 5/2011 | Ishikawa |
| 8,010,026 | B2 | 8/2011 | Kobayashi et al. |
| RE42,796 | E | 10/2011 | Ishii |
| 8,090,272 | B2 | 1/2012 | Ishikawa |
| 8,099,025 | B2 | 1/2012 | Ishikake |
| 8,126,366 | B2 | 2/2012 | Hattori |
| 8,417,130 | B2 | 4/2013 | Hashimoto |
| 8,463,145 | B2 | 6/2013 | Ukai et al. |
| 8,583,009 | B2 | 11/2013 | Takagi |
| 8,600,244 | B2 | 12/2013 | Hashimoto |
| 8,620,180 | B2 | 12/2013 | Shiraki et al. |
| 8,666,293 | B2 | 3/2014 | Mushika et al. |
| 8,744,288 | B2 | 6/2014 | Shinoya et al. |
| 8,761,643 | B2 | 6/2014 | Mushika et al. |
| 8,849,133 | B2 | 9/2014 | Itabashi et al. |
| 8,867,932 | B2 | 10/2014 | Ukai et al. |
| 8,948,617 | B2 | 2/2015 | Shiraki et al. |
| 8,948,661 | B2 | 2/2015 | Mushika et al. |
| 9,195,207 | B2 | 11/2015 | Itabashi |
| 9,207,567 | B2 | 12/2015 | Mushika et al. |
| 2003/0185579 | A1 | 10/2003 | Nishino et al. |
| 2003/0185594 | A1 | 10/2003 | Okabe |
| 2003/0215265 | A1 | 11/2003 | Kawai |
| 2006/0034625 | A1 | 2/2006 | Kajikawa |
| 2006/0104670 | A1 | 5/2006 | Nishitani et al. |
| 2006/0165423 | A1 | 7/2006 | Nishitani et al. |
| 2006/0171737 | A1 | 8/2006 | Nishimura et al. |
| 2006/0193643 | A1 | 8/2006 | Takagi et al. |
| 2006/0193646 | A1 | 8/2006 | Suzuki et al. |
| 2006/0245787 | A1 | 11/2006 | Ito et al. |
| 2007/0031158 | A1 | 2/2007 | Kamimura |
| 2007/0041747 | A1 | 2/2007 | Kim et al. |
| 2007/0059018 | A1 | 3/2007 | Tokuda |
| 2007/0059038 | A1 | 3/2007 | Shiraki |
| 2007/0077101 | A1 | 4/2007 | Tamura et al. |
| 2007/0122165 | A1 | 5/2007 | Igarashi et al. |
| 2007/0140709 | A1 | 6/2007 | Yoshida et al. |
| 2007/0140725 | A1* | 6/2007 | Kamimura ..... 399/90 |
| 2007/0253748 | A1 | 11/2007 | Matsumoto et al. |
| 2008/0080904 | A1 | 4/2008 | Murayama et al. |
| 2008/0205911 | A1 | 8/2008 | Ishikawa et al. |
| 2008/0205928 | A1 | 8/2008 | Ishikawa |
| 2008/0205931 | A1 | 8/2008 | Ishikawa |
| 2008/0223173 | A1 | 9/2008 | Ishikawa |
| 2008/0317509 | A1 | 12/2008 | Mori |
| 2009/0000423 | A1 | 1/2009 | Ishikawa et al. |
| 2009/0052911 | A1 | 2/2009 | Richey et al. |
| 2009/0084210 | A1 | 4/2009 | Tsukada et al. |
| 2009/0169247 | A1 | 7/2009 | Hattori |
| 2009/0257782 | A1 | 10/2009 | Ishikake |
| 2009/0269085 | A1 | 10/2009 | Ukai |
| 2009/0269086 | A1 | 10/2009 | Mikuni |
| 2009/0285604 | A1 | 11/2009 | Nakajima |
| 2009/0297226 | A1 | 12/2009 | Nagashima et al. |
| 2010/0054763 | A1 | 3/2010 | Tomiyori et al. |
| 2010/0209144 | A1 | 8/2010 | Nieda |
| 2011/0023368 | A1 | 2/2011 | Mizutani et al. |
| 2011/0038649 | A1 | 2/2011 | Miyabe et al. |
| 2011/0081163 | A1 | 4/2011 | Lee |
| 2011/0123231 | A1 | 5/2011 | Ozawa et al. |
| 2011/0236062 | A1 | 9/2011 | Takagi |
| 2011/0236065 | A1 | 9/2011 | Takagi |
| 2011/0236066 | A1 | 9/2011 | Takagi |
| 2011/0243578 | A1 | 10/2011 | Ukai et al. |
| 2012/0014713 | A1 | 1/2012 | Murakami et al. |
| 2012/0051795 | A1 | 3/2012 | Mushika et al. |
| 2012/0057905 | A1 | 3/2012 | Itabashi |
| 2012/0134688 | A1 | 5/2012 | Hashimoto |
| 2012/0148297 | A1 | 6/2012 | Peng et al. |
| 2012/0177398 | A1 | 7/2012 | Takigawa |
| 2012/0243882 | A1 | 9/2012 | Carot |
| 2012/0251165 | A1 | 10/2012 | Mushika et al. |
| 2012/0251216 | A1 | 10/2012 | Mushika |
| 2012/0321345 | A1 | 12/2012 | Shinoya et al. |
| 2013/0051813 | A1 | 2/2013 | Itabashi et al. |
| 2013/0051814 | A1 | 2/2013 | Itabashi et al. |
| 2013/0051815 | A1 | 2/2013 | Itabashi et al. |
| 2013/0051816 | A1 | 2/2013 | Itabashi |
| 2013/0051833 | A1 | 2/2013 | Itabashi et al. |
| 2013/0084083 | A1 | 4/2013 | Itabashi et al. |
| 2013/0136460 | A1 | 5/2013 | Shiraki et al. |
| 2013/0170844 | A1 | 7/2013 | Itabashi |
| 2013/0170845 | A1 | 7/2013 | Itabashi |
| 2013/0259528 | A1 | 10/2013 | Yamamoto |
| 2013/0272724 | A1 | 10/2013 | Ukai et al. |
| 2014/0020489 | A1 | 1/2014 | Nozaki et al. |
| 2014/0086638 | A1 | 3/2014 | Sato |
| 2014/0169835 | A1 | 6/2014 | Nakajima |
| 2014/0219690 | A1 | 8/2014 | Li et al. |
| 2014/0294403 | A1 | 10/2014 | Shimizu |
| 2014/0341617 | A1 | 11/2014 | Mushika et al. |
| 2014/0363189 | A1 | 12/2014 | Hashimoto et al. |
| 2014/0376968 | A1 | 12/2014 | Yamamoto et al. |
| 2015/0000443 | A1 | 1/2015 | Shimizu |
| 2015/0003844 | A1 | 1/2015 | Ukai et al. |
| 2015/0005134 | A1 | 1/2015 | Shimizu |
| 2015/0010334 | A1 | 1/2015 | Nakajima |
| 2015/0037071 | A1 | 2/2015 | Yamamoto |
| 2015/0043944 | A1 | 2/2015 | Yamamoto |
| 2015/0104222 | A1 | 4/2015 | Mushika et al. |
| 2015/0117873 | A1 | 4/2015 | Mori et al. |
| 2015/0117906 | A1 | 4/2015 | Mori |
| 2015/0153675 | A1 | 6/2015 | Itabashi et al. |

FOREIGN PATENT DOCUMENTS

| | | | |
|---|---|---|---|
| CN | 1828447 | A | 9/2006 |
| CN | 1288515 | C | 12/2006 |
| CN | 2884266 | Y | 3/2007 |
| CN | 1983078 | A | 6/2007 |
| CN | 101063855 | A | 10/2007 |
| CN | 200962188 | Y | 10/2007 |
| CN | 101256379 | A | 9/2008 |
| CN | 101295157 | A | 10/2008 |
| CN | 201170840 | Y | 12/2008 |
| CN | 100476636 | C | 4/2009 |
| CN | 201222170 | Y | 4/2009 |
| CN | 101625537 | B | 1/2010 |
| CN | 201402371 | Y | 2/2010 |
| CN | 201464807 | U | 5/2010 |
| CN | 201489284 | U | 5/2010 |
| CN | 202102251 | U | 1/2012 |
| CN | 202472249 | U | 10/2012 |
| CN | 102799090 | A | 11/2012 |
| CN | 202649679 | U | 1/2013 |
| CN | 203673223 | U | 6/2014 |
| EP | 0838733 | A2 | 4/1998 |
| EP | 1696278 | A2 | 8/2006 |
| EP | 1696278 | A3 | 8/2006 |
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |

(56) References Cited

FOREIGN PATENT DOCUMENTS

| | | | |
|---|---|---|---|
| EP | 2378378 | A2 | 10/2011 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 20111015051 | A1 | 2/2011 |
| WO | 2013040989 | A1 | 3/2013 |
| WO | 2013073134 | A1 | 5/2013 |

OTHER PUBLICATIONS

Dec. 11, 2012 (CN) App. No. 201110251898.6—Notification of the First Office Action with Search Report.
Jan. 5, 2012—(JP) Decision of Patent Grant—App 2010-083408.
Jun. 26, 2012 (JP) App No. 2010-193204—Notice of Reasons for Rejection.
Sep. 18, 2012 (JP) App. No. 2010-193204—Decision to Grant a Patent.
Feb. 19, 2013 (JP) App. No. 2012-229560—Notice of Reasons for Rejection.
Oct. 16, 2013 (US) U.S. App. No. 13/222,096—Notice of Allowance.
Oct. 15, 2013 (CN) App. No. 201110251898.6—Office Action.
Dec. 31, 2014—(CN) Notification of First Office Action—App 201310175410.5, Eng Tran.
Feb. 10, 2014 (US) U.S. Appl. No. 14/154,521—Notice of Allowance.
Feb. 27, 2014—(KR) Notice of Preliminary Rejection—App 10-2012-7028457.
Nov. 12, 2014—(US) Non-Final Office Action—U.S. Appl. No. 14/485,462.
Sep. 19, 2014—(US) Notice of Allowance—U.S. Appl. No. 14/275,251.
Apr. 6, 2015—(US) Non-Final Office Action—U.S. Appl. No. 14/316,959.
Apr. 21, 2015—(EP) Extended Search Report—App 14173865.8.
Mar. 3, 2015—(CN) Notification of First Office Action—App 201310175229.4, Eng Tran.
Mar. 3, 2015—(CN) Notification of First Office Action—App 201310175264.6, Eng Tran.
Mar. 19, 2015—(US) Non-Final Office Action—U.S. Appl. No. 14/577,396.
Mar. 20, 2015—(US) Final Office Action—U.S. Appl. No. 14/485,462.
Mar. 27, 2015—(US) Co-pending U.S. Appl. No. 14/670,502.
Mar. 27, 2015—(US) Co-pending U.S. Appl. No. 14/670,676.
May 8, 2015—(US) Ex Parte Quayle—U.S. Appl. No. 14/316,971.
May 8, 2015—Ex Parte Quayle—U.S. Appl. No. 14/316,971.
Co-pending U.S. Appl. No. 14/316.959 filed Jun. 27, 2014.
Co-Pending U.S. Appl. No. 14/316,971 filed Jun. 27, 2014.
Machine translation of JP 07-281519A dated May 2, 2013.
Machine translation of JP 10-031382A dated May 1, 2013.
Machine translation of JP 2006-235236 dated Jan. 9, 2014.
Non-Final Office Action received in corresponding U.S. Appl. No. 13/628,492 mailed Apr. 14, 2014.
Sep. 23, 2014—(US) Notice of Allowance—U.S. Appl. No. 13/628,492.
May 18, 2015—(US) Non-Final Office Action—U.S. Appl. No. 14/611,393.
Aug. 4, 20105—(US) Notice of Allowance—U.S. Appl. No. 14/577,396.
Aug. 20, 2015—(EP) Extended EP Search Report in App No. 15161221.5.
Aug. 21, 2015—(EP) Extended Search Report—App 15161258.7.
Aug. 25, 2015—(US) Non-Final Office Action—U.S. Appl. No. 14/671,413.
Jul. 22, 2015—(US) Non-Final Office Action—U.S. Appl. No. 14/316,971.
Oct. 5, 2015—(US) Non-Final Office Action—U.S. Appl. No. 14/670,801.

(56) References Cited

OTHER PUBLICATIONS

Oct. 19, 2015—(US)—Non-Final Office Action—U.S. Appl. No. 14/611,393.
Sep. 16, 2015—(US) Notice of Allowance—U.S. Appl. No. 14/485,462.
Sep. 17, 2015—(EP) Office Action—App 11179283.4.
Sep. 17, 2015—(EP) Office Action—App 11160291.8.
Sep. 17, 2015—(US) Non-Final Office Action—U.S. Appl. No. 14/670,489.
Sep. 30, 2015—(US) Non-Final Office Action—U.S. Appl. No. 14/670,522.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US)—Non-Final Office Action—U.S. Appl. No. 14/926,345.
Dec. 17, 2015—(US)—Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2014—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb. 25, 2016—(US) Non-Final Office Action—U.S. Appl. No. 14/316,959.
Feb. 2, 2016—(US) Notice of Allowance—U.S. Appl. No. 14/670,516.
Feb. 17, 2016—(US) Notice of Allowance—U.S. Appl. No. 14/671,413.
Mar. 4, 2016—(US) Notice of Allowance—U.S. Appl. No. 14/491,157.
Mar. 29, 2016—(US) Notice of Allowance—U.S. Appl. No. 14/485,462.
Apr. 1, 2016—(US) Notice of Allowance—U.S. Appl. No. 141926,345.
Apr. 12, 2016—(US) Notice of Allowance—U.S. Appl. No. 141611,393.
Apr. 14, 2016—(US) Notice of Allowance—U.S. Appl. No. 14/670,522.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
May 27, 2016—(US) Notice of Allowance—U.S. Appl. No. 14/671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
Jun 22, 2016—(US) Notice of Allowance—U.S. Appl. No. 14/670,516.
May 24, 2016—(EP) Communication—App 12157679.7.
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
Aug. 1, 2016—(US) Notice of Allowance—U.S. Appl. No. 14/670,516.
Jul. 15, 2016—(US) Notice of Allowance—U.S. Appl. No. 14/670,522.
Sep. 12, 2016—(US) Notice of Allowance—U.S. Appl. No. 14/589,696.
Sep. 28, 2016—(US) Notice of Allowance—U.S. Appl. No. 14/670,801.
Jul. 14, 2016—(US) Notice of Allowance—U.S. Appl. No. 14/670,676.
Aug. 9, 2016—(US) Notice of Allowance—U.S. Appl. No. 15/079,829.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

CARTRIDGE HAVING AGITATOR AND ROTARY MEMBER WITH DETECTED PORTION

CROSS REFERENCE TO RELATED APPLICATION

This application claims priority from Japanese Patent Application No. 2013-227251 filed Oct. 31, 2013. The entire content of the priority application is incorporated herein by reference.

TECHNICAL FIELD

The present invention relates to a cartridge mountable in an image forming apparatus employing an electro-photographic system.

BACKGROUND

An electro-photographic printer having a developing cartridge detachably mounted therein is well known in the art. Conventionally, this type of printer is provided with a sensor for detecting whether a mounted developing cartridge is a new product.

As one example of such printers, Japanese Patent Application Publication No. 2011-215374 discloses a laser printer including a main casing and a developing cartridge. The main casing is provided with an actuator and an optical sensor. The developing cartridge includes a detected rotary body and an agitator gear. The detected rotary body is provided with a disc-shaped gear part having gear teeth along a portion of its circumferential surface and a tooth lacking part, and a detected part erecting on a left endface of the gear part. The agitator gear is provided with a large-diameter gear part configured to receive a drive force, and a small-diameter gear part configured to intermesh with the gear teeth of the disc-like gear part of the detected rotary body.

In this conventional laser printer, a drive force is transmitted to the detected rotary body via the agitator gear. Upon receipt of the drive force, the detected rotary body is rotated so that the detected part is brought into abutment with the actuator to pivotally move the same. Upon detection of the pivotal movement of the actuator by the optical sensor, the laser printer can determine information on the developing cartridge.

SUMMARY

However, according to the developing cartridge described in the JP publication, the agitator gear is attached to a rotation shaft of an agitator so as to be incapable of rotating relative to the rotation shaft, and is rotated integrally therewith. Therefore, the agitator gear may be decentered due to deformation of the agitator rotation shaft caused by application of load to the agitator during rotation of the agitator. Thus, insufficient meshing engagement occurs between the agitator gear and the teeth of the gear part of the detected rotary body, and accordingly, insufficient transmission of the driving force to the detected rotary body from the agitator gear may occur.

In this case, stabilized rotational driving in the detected rotary body may become difficult, and the detected portion of the detected rotary body cannot permit the actuator to pivotally move, and consequently, the optical sensor cannot detect the pivotal motion of the actuator.

As a result, in the laser printer, accuracy of detection as to the information of the developing cartridge may be lowered.

It is therefore, an object of the present invention to provide a cartridge capable of enhancing detection accuracy as to the information of the cartridge.

In order to attain the above and other objects, the invention provides a cartridge including: a housing; an agitator; a first rotary member; and a second rotary member. The housing is configured to accommodate therein developer. The agitator is positioned in the housing and rotatable relative to the housing about an axis defining an axial direction. The first rotary member has a detected portion and a first abutment portion and rotatable relative to the housing. The second rotary member is rotatable relative to the housing and has a second abutment portion abuttable on the first abutment portion. The second rotary member is configured to transmit driving force to the first rotary member. The first rotary member is configured to move from a first position spaced apart from the second rotary member to a second position contacting the second rotary member to receive the driving force from the second rotary member. The agitator includes: a rotation shaft; and an agitation blade. The rotation shaft extends in the axial direction and has an axial end portion at which the second rotary member is supported. The agitation blade is supported to the rotation shaft and resiliently deformable. The agitation blade is in contact with and spaced away from the housing in accordance with the rotation of the rotation shaft. The second rotary member is configured such that while the agitation blade is being spaced apart from the housing, the second abutment portion contacts the first abutment portion in accordance with rotation of the second rotary member to move the first rotary member from the first position to the second position, thereby transmitting the driving force from the second rotary member to the first rotary member.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overview of Developing Cartridge

Figure 1:
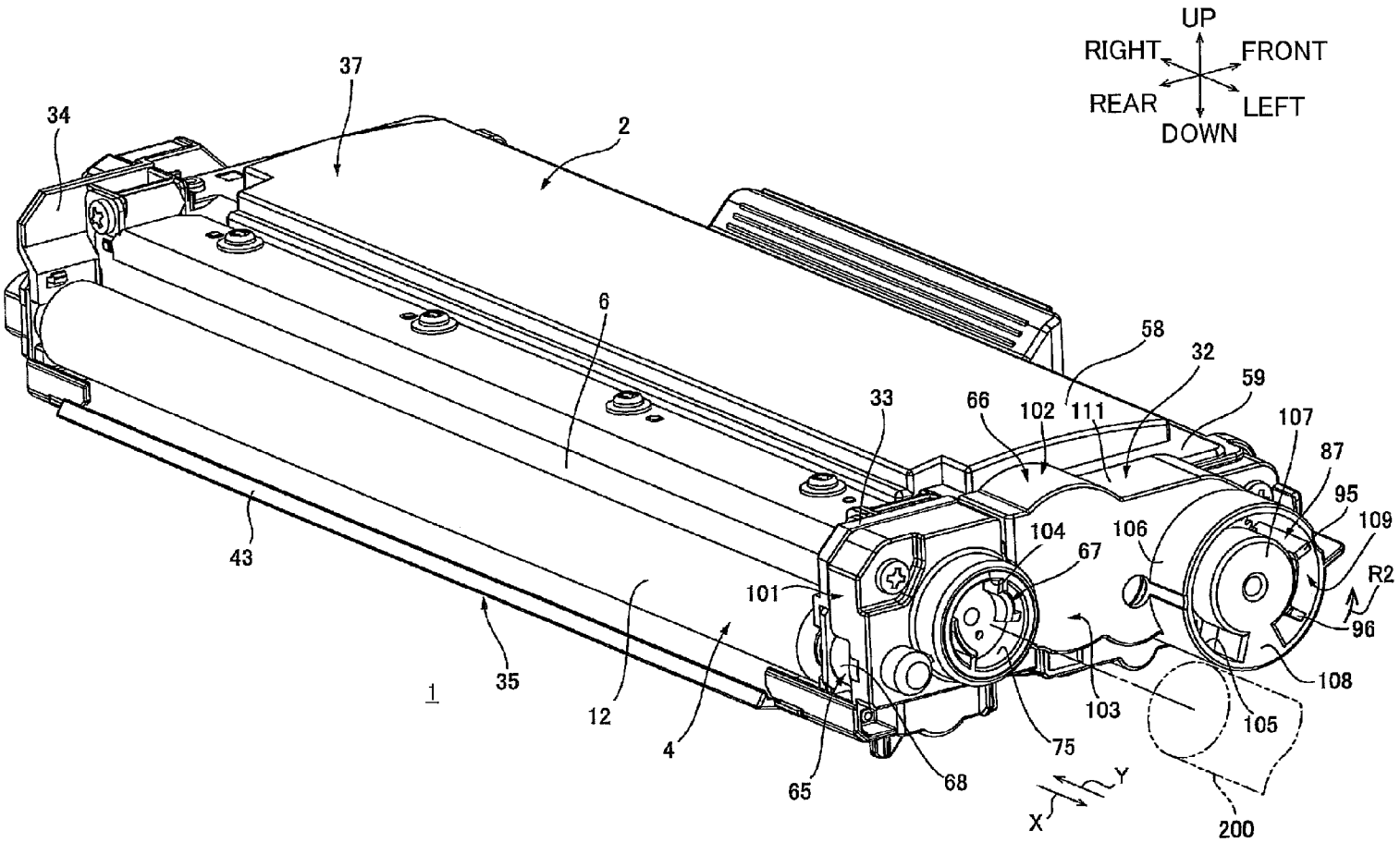
FIG. 1 is a perspective view as viewed from left-rear side of a developing cartridge in accordance with a first embodiment of the invention.
Figure 4B:
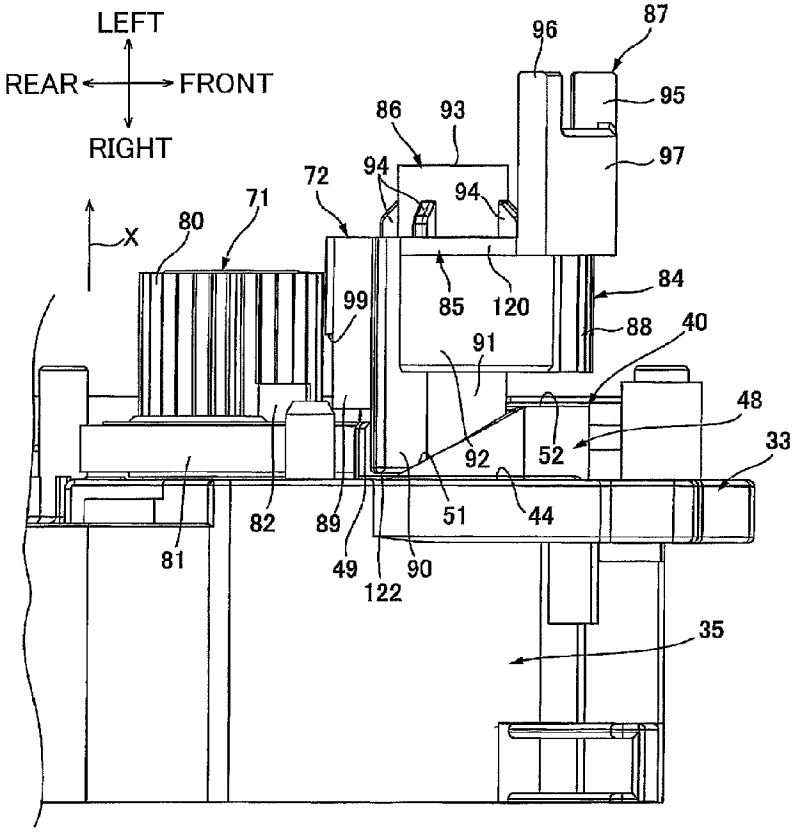
FIG. 4B is a bottom view of the detection gear and an agitator gear illustrated in FIG. 4A.
Figure 5:
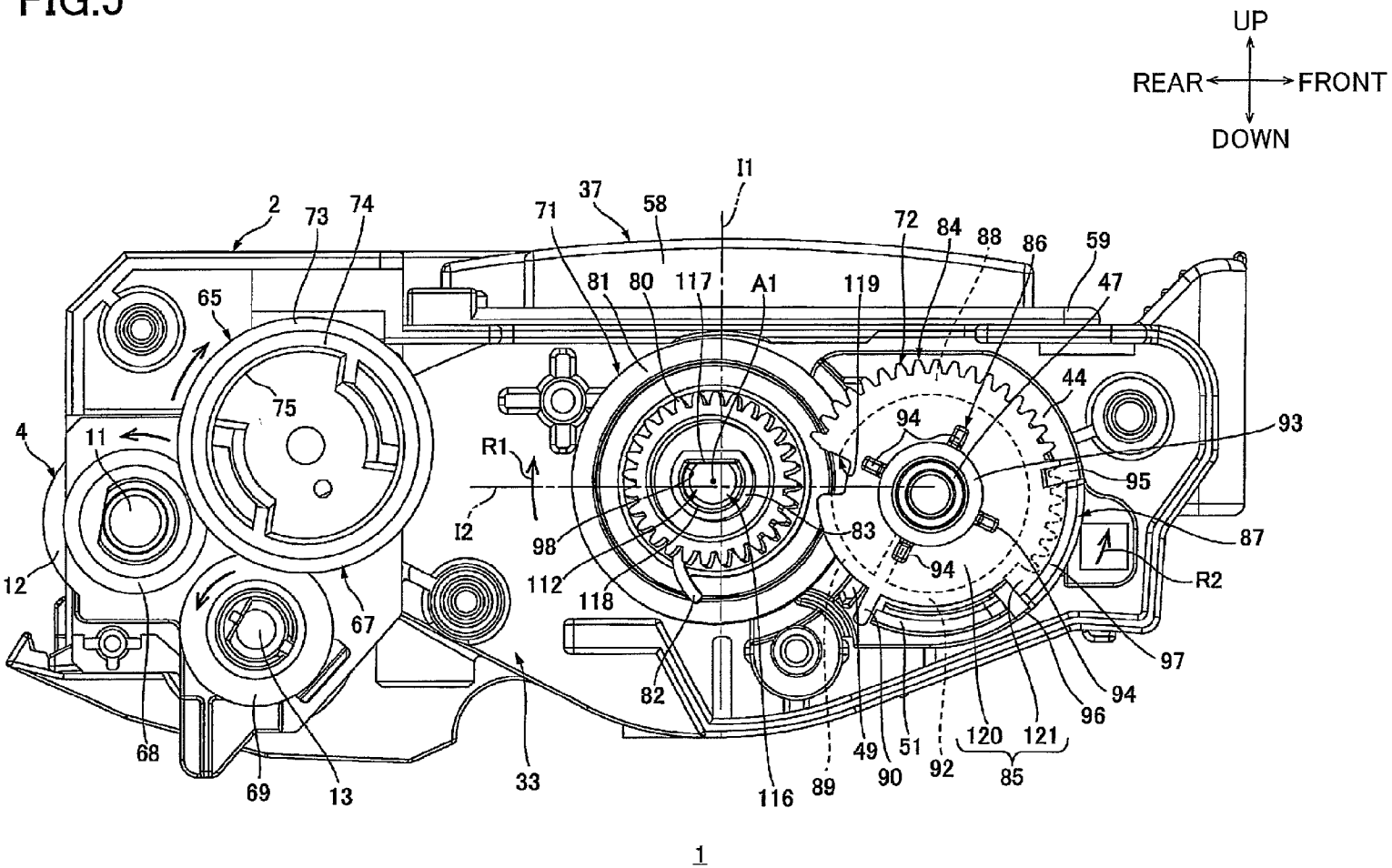
FIG. 5 is an explanatory diagram illustrating a new product detecting operation performed by the detection unit shown in FIG. 4A, in which the detection gear is in the initial position and the flat surface of a gear attachment portion is oriented upward.
Figures 6A, 6B:
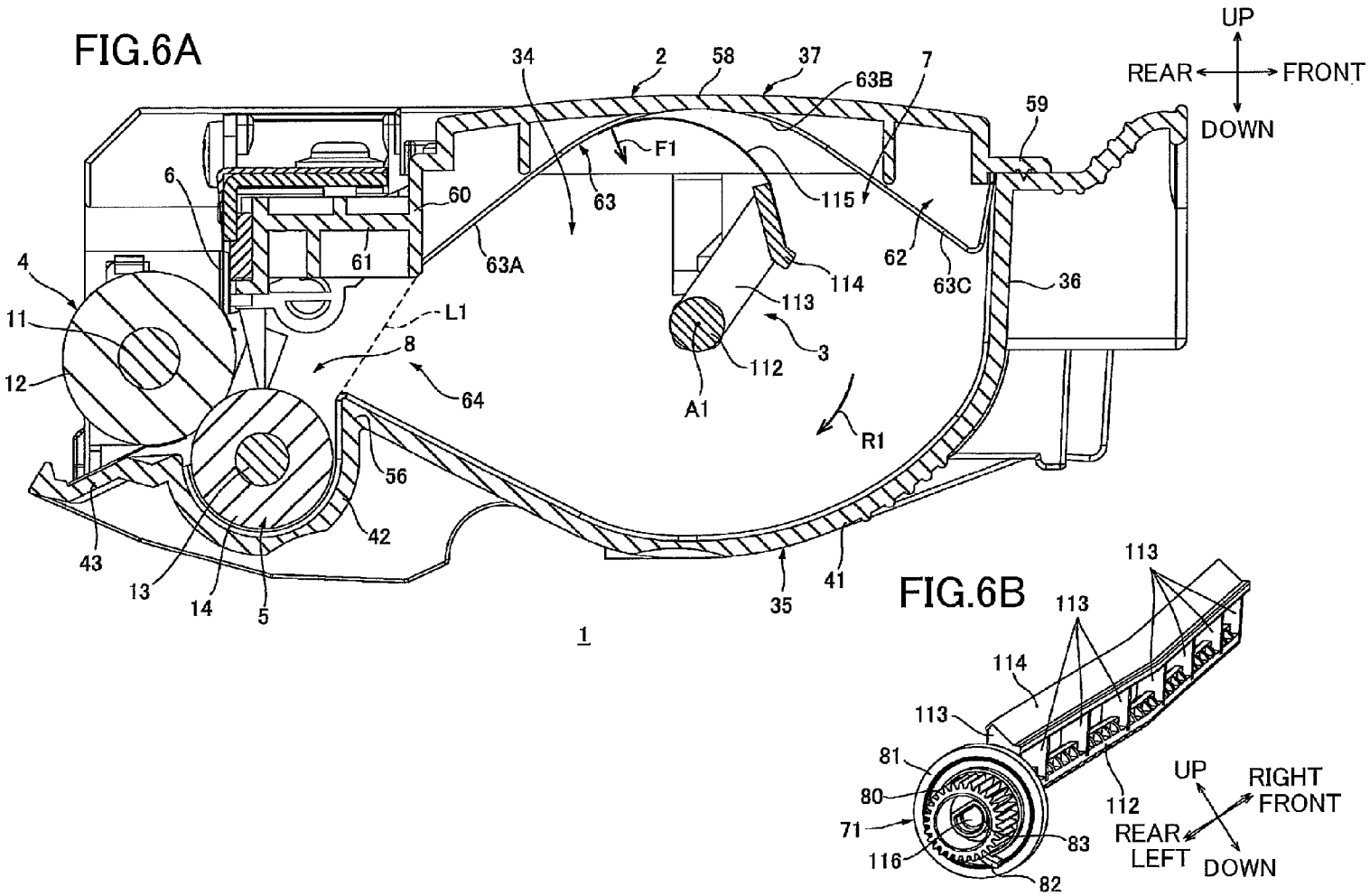
FIG. 6A a center cross-sectional view of the developing cartridge shown in FIG. 5.
FIG. 6B is a perspective view of an agitator illustrated in FIG. 6A and an agitator gear as viewed from left-front side.

First, a developing cartridge 1 according to a first embodiment of the present invention will be described with reference to FIGS. 1 through 14. The developing cartridge 1 serves as an example of a cartridge. As shown in FIGS. 1 and 6A, the developing cartridge 1 includes a housing 2, an agitator 3, a developing roller 4, a supply roller 5, and a thickness-regulating blade 6.

In the following description, the side of the developing cartridge 1 in which the developing roller 4 is provided will be considered the rear, while the opposite side will be considered the front. Further, left and right sides of the developing cartridge 1 will be defined based on the perspective of a user looking at the developing cartridge 1 from the front. Specifically, directions related to the developing cartridge 1 in the following description will correspond to arrows shown in the drawings. Thus, the left side of FIG. 6A is the rear, the right side is the front, the near side the left side, and the far side is the right side.

As noted in FIG. 1, the direction from the right end toward the left end of the developing cartridge 1 will be referred to as a first direction X while the opposite direction, i.e., the direction from the left end to the right end will be referred to as a second direction Y. Further, both first and second directions X and Y will be referred to as an axial direction.

The housing 2 has a box-like shape that is elongated in a leftward/rightward direction. An opening is formed in the rear side of the housing 2 and penetrates the rear side in a frontward/rearward direction. The housing 2 is adapted to accommodate therein toner as an example of a developer.

As shown in FIG. 6A, the agitator 3 is disposed in an approximate front region within the housing 2.

2. Employment Mode of Developing Cartridge

Figure 2:
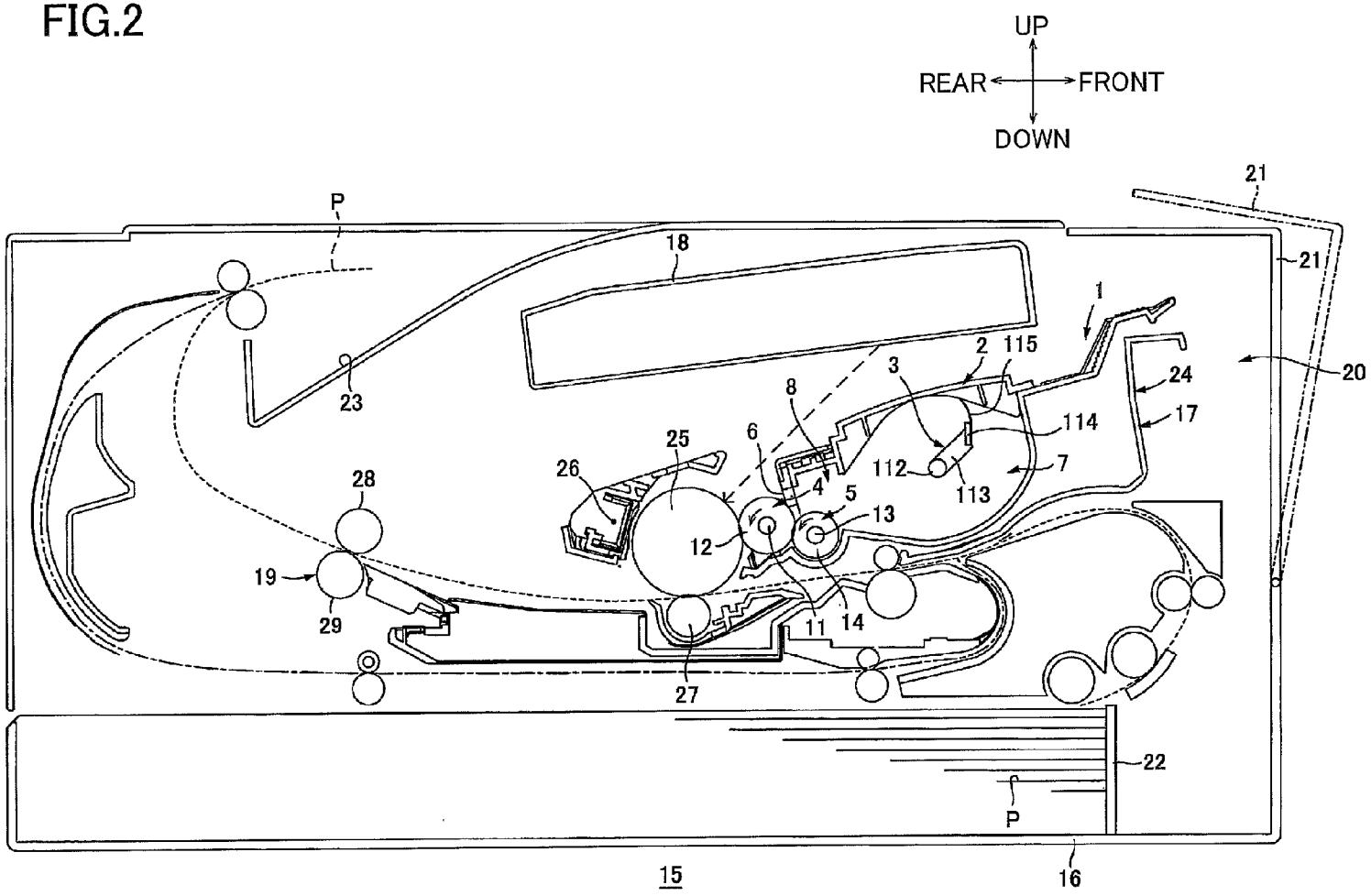
FIG. 2 is a center cross-sectional view of a printer mounted with the developing cartridge shown in FIG. 1.

The developing cartridge 1 is assembled to a printer 15 as shown in FIG. 2.

The printer 15 is an electro-photographic type monochrome printer. The printer 15 includes a main casing 16, a process cartridge 17, a scanning unit 18, and a fixing unit 19.

The main casing 16 has a box-like shape and includes an access opening 20, a front cover 21, a sheet supply tray 22, and a discharge tray 23.

The access opening 20 is formed in a front wall of the main casing 16 and penetrates the front wall in the frontward/rearward direction. The access opening 20 allows passage of the process cartridge 17 into and out of the main casing 16.

The front cover 21 is pivotally movably supported on the front wall of the main casing 16 about its bottom end in order to open or cover the access opening 20.

The sheet supply tray 22 is disposed in a bottom section of the main casing 16. The sheet supply tray 22 is adapted to accommodate sheets P of paper.

The discharge tray 23 is provided on a top surface of the main casing 16, such that the top surface is concaved downward for mounting the sheet P thereon.

The process cartridge 17 can be mounted into or removed from the main casing 16 through the access opening 20. The process cartridge 17 includes a drum cartridge 24, and the above-described developing cartridge 1.

The drum cartridge 24 includes a photosensitive drum 25, a scorotron charger 26, and a transfer roller 27.

The photosensitive drum 25 is disposed in a rear end portion of the drum cartridge 24. The photosensitive drum 25 has a general cylindrical shape that extends in the leftward/rightward direction.

The scorotron charger 26 is disposed to the rear of the photosensitive drum 25 and is spaced away from the photosensitive drum 25.

The transfer roller 27 is disposed below the photosensitive drum 25 and contacts a bottom end of the same.

The developing cartridge 1 can be mounted in and removed from the drum cartridge 24. When the developing cartridge 1 is mounted in the drum cartridge 24, a rear end portion of the developing roller 4 is in contact with a front end portion of the photosensitive drum 25.

The scanning unit 18 is disposed above the process cartridge 17. The scanning unit 18 is configured to irradiate a laser beam on a basis of image data toward the photosensitive drum 25 as indicated by a broken line in FIG. 2.

The fixing unit 19 is disposed rearward of the process cartridge 17. The fixing unit 19 includes a heating roller 28, and a pressure roller 29.

The printer 15 performs an image-forming operation under control of a control unit (not shown). At the beginning of this image-forming operation, the scorotron charger 26 applies a uniform charge to the surface of the photosensitive drum 25. Next, the scanning unit 18 exposes the surface of the photosensitive drum 25 to light by the laser beam, forming an electrostatic latent image on the surface of the photosensitive drum 25 based on image data.

The agitator 3 agitates toner in the housing 2 and supplies the agitated toner to the supply roller 5. The supply roller 5 supplies the toner received from the agitator 3 to the developing roller 4. At this time, the toner is positively tribocharged between the developing roller 4 and supply roller 5 while being transferred to the surface of the developing roller 4. The thickness-regulating blade 6 regulates the toner carried on the surface of the developing roller 4 at a uniform thickness.

The developing roller 4 supplies toner at this uniform thickness to the electrostatic latent image formed on the surface of the photosensitive drum 25 so that the photosensitive drum 25 now carries a toner image on its surface.

Through the rotation of various rollers provided in the printer 15, sheets P are supplied one at a time and at a prescribed timing from the sheet supply tray 22 to a position between the photosensitive drum 25 and transfer roller 27. The toner image carried on the photosensitive drum 25 is transferred onto the sheet P as the sheet P passes between the photosensitive drum 25 and transfer roller 27.

Next, the sheet P passes between the heating roller 28 and pressure roller 29, which apply heat and pressure to the sheet P for thermally fixing the toner image to the sheet P. Subsequently, the sheet P is discharged onto the discharge tray 23.

3. Details of Developing Cartridge

The developing cartridge 1 includes a detection unit 32. The detection unit 32 is located at the left end of the housing 2 as shown in FIG. 1.

(1) Housing

The housing 2 is of a substantially box shape and is opened toward the rear as shown in FIGS. 1 and 6A. The housing 2 includes a right side wall 34, a left side wall 33 (as an example of wall portion), a front wall 36, a bottom wall 35, and an upper wall 37.

The right side wall 34 is provided on a right end portion of the housing 2. The right side wall 34 has a plate shape that is generally rectangular in a side view and elongated in the frontward/rearward direction.

Figures 3A, 3B:
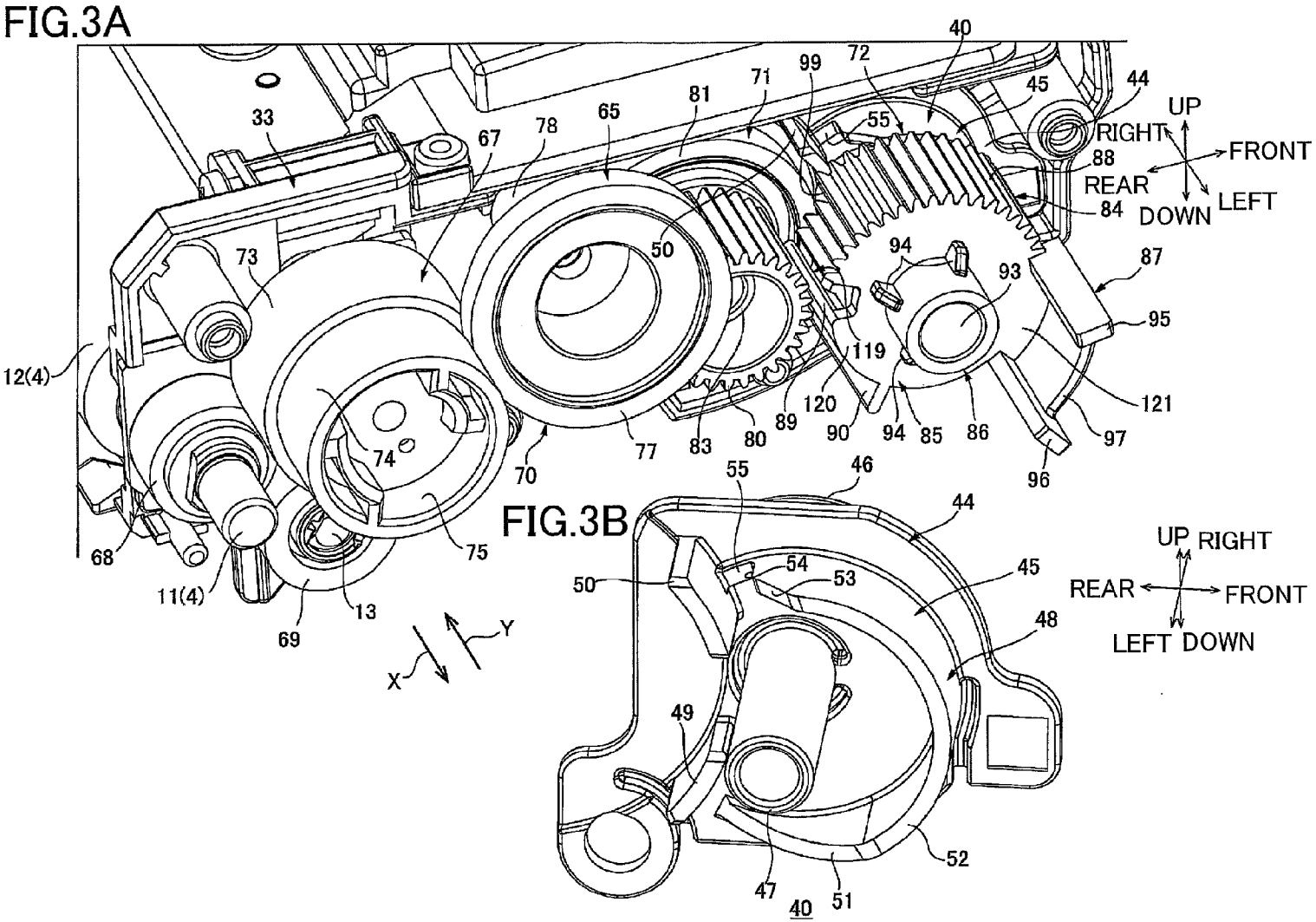
FIG. 3A is a perspective view as viewed from left-upper side of a gear train provided in the developing cartridge illustrated in FIG. 1 and showing that a detection gear is in an initial position.
FIG. 3B is a perspective view as viewed from left-upper side of a cap illustrated in FIG. 3A.

The left side wall 33 is provided on a left end portion of the housing 2. The left side wall 33 is located leftward of the right side wall 34 and spaced apart from the right side wall 34. As shown in FIG. 3A, the left side wall 33 has a plate shape that is generally rectangular in a side view and elongated in the frontward/rearward direction. The left side wall 33 is formed with a toner supply opening (not shown) and is provided with a cap 40 as shown in FIGS. 3A and 3B.

The toner supply opening is disposed at a front end portion of the left side wall 33 and penetrates the left side wall 33 in the leftward/rightward direction. The toner supply opening provides a communication between the inside of a toner accommodating chamber 7 described later and an external space of the housing 2 in the leftward/rightward direction.

The cap 40 is configured to be attached to and detached from the toner supply opening. As shown in FIG. 3B, the cap 40 integrally includes a closure portion 44, an insertion portion 46, and a detection gear support portion 45.

The closure portion 44 has a substantially rectangular plate shape in a side view. The insertion portion 46 is disposed on a right surface of the closure portion 44. The insertion portion 46 has a substantially cylindrical shape elongated in the leftward/rightward direction and protrudes rightward from the right surface of the closure portion 44. The insertion portion 46 has an outer diameter substantially equivalent to an inner diameter of the toner supply opening.

The detection gear support portion 45 is provided on a left surface of the closure portion 44. The detection gear support portion 45 includes a detection gear support shaft 47, a guide portion 48, a first stop 49, and a second stop 50.

The detection gear support shaft 47 is disposed on a substantially center portion of the left surface of the closure portion 44 in a side view. The detection gear support shaft 47 has a substantially cylindrical shape extending in the leftward/rightward direction and protrudes leftward from the left surface of the closure portion 44.

The guide portion 48 is in the shape of letter "C" in a side view with the opening of the "C" facing rearward. The guide portion 48 has substantially a semi-cylindrical shape extending in the leftward/rightward direction. The guide portion 48 protrudes leftward from the left surface of the closure portion 44. The guide portion 48 is spaced away from an outer peripheral surface of the detection gear support shaft 47 and disposed so as to surround the detection gear support shaft 47 from forward.

The guide portion 48 defines a first sloped surface 51, a first parallel surface 52, a second sloped surface 53, and a second parallel surface 55, and formed with a notched surface 54.

The first sloped surface 51 is positioned at an upstream end portion on a left surface of the guide portion 48 in a counterclockwise direction in a left side view. The first sloped surface 51 is continuously connected to the left surface of the closure portion 44 and slopes leftward while progressing downstream in the counterclockwise direction in the left side view.

The first parallel surface 52 is continuously connected to a downstream end portion of the first sloped surface 51 in the counterclockwise direction in the left side view. The first parallel surface 52 extends downstream in the counterclockwise direction in the left side view while staying parallel to the left surface of the closure portion 44.

The second sloped surface 53 is continuously connected to a downstream end portion of the first parallel surface 52 in the counterclockwise direction in the left side view. The second sloped surface 53 slopes rightward while progressing downstream in the counterclockwise direction in the left side view.

The notched surface 54 is a rightward cutout formed in a downstream end portion of the second sloped surface 53 in the counterclockwise direction in the left side view.

The second parallel surface 55 is continuously connected to a right end portion of the notched surface 54 and extends downstream in the counterclockwise direction in the left side view while staying parallel to the left surface of the closure portion 44.

The first stop 49 is separated rearward from the upstream end portion of the guide portion 48 in the counterclockwise direction in the left side view. The first stop 49 has a plate shape extending along a peripheral surface of a first gear portion 81 described later and protrudes leftward from the left surface of the closure portion 44.

The second stop 50 is located at the rear side of the notched surface 54 with a space therebetween. The second stop 50 has a plate shape extending along the peripheral surface of the first gear portion 81 described later and protrudes leftward from the left surface of the closure portion 44.

As shown in FIG. 3A, the cap 40 is mounted on the left side wall 33 by inserting the insertion portion 46 into the toner supply opening. Thus, the closure portion 44 of the cap 40 closes the toner supply opening from the left side.

As shown in FIG. 6A, the front wall 36 is disposed at a front end portion of the housing 2 and extends between a front end portion of the left side wall 33 and a front end portion of the right side wall 34. The front wall 36 has a rectangular shape in a front view elongated in the leftward/rightward direction.

The bottom wall 35 is disposed at a bottom end portion of the housing 2 and extends between a bottom end portion of the right side wall 34 and a bottom end portion of the left side wall 33. The bottom wall 35 has a front end portion connected to a bottom end portion of the front wall 36. Specifically, the bottom wall 35 integrally includes a curved portion 41, an arcuate portion 42, and a lip portion 43.

The curved portion 41 is a front portion of the bottom wall 35 and continuously extends rearward from a bottom end portion of the front wall 36. The curved portion 41 has a center portion in the frontward/rearward direction curved and depressed downward.

The arcuate portion 42 is positioned adjacent to the rear side of the curved portion 41. The arcuate portion 42 has a semi-circular arc shape with an opening upward in a side view. The arcuate portion 42 has an inner peripheral surface extending along a peripheral surface of the supply roller 5. The arcuate portion 42 has a front end portion continuously connected to a rear end portion of the curved portion 41. The connecting portion 56 connecting the arcuate portion 42 to the curved portion 41 is of a V shape in the side view having a peak oriented diagonally above and rearward.

The lip portion 43 is positioned adjacent to the rear side of the arcuate portion 42 and continuously extends rearward from a rear end portion of the arcuate portion 42.

As shown in FIG. 1, the upper wall 37 is an upper end portion of the housing 2 and has a plate shape extending in the leftward/rightward direction. The upper wall 37 is an integral component having a bulged portion 58, a flange portion 59, a partitioning portion 60, a flat plate portion 61 and a contact portion 62, as shown in FIG. 6A.

The bulged portion 58 is a front portion of the upper wall 37. The bulged portion 58 has a recessed or concaved shape with its open side facing downward. The bulged portion 58 extends in the leftward/rightward direction as shown in FIG. 1.

The flange portion 59 is disposed leftward, rightward and frontward of the bulged portion 58 such that the flange portion 59 surrounds the bulged portion 58 in a plan view. That is, the flange portion 59 has a generally U-shape in a plan view with the opening of the "U" facing rearward. The flange portion 59 is connected to a lower edge of the bulged portion 58.

The flange portion 59 is welded on a front part of an upper end portion of the right side wall 34, a front part of an upper end portion of the left side wall 33, and an upper end portion of the front wall 36.

The partitioning portion 60 is positioned rearward of and adjacent to the bulged portion 58, as shown in FIG. 6A. The partitioning portion 60 has a generally rectangular plate shape extending in the leftward/rightward direction in a rear side view. The partitioning portion 60 has an upper end portion connected with a lower end portion of a rear wall of the bulged portion 58. The partitioning portion 60 has a lower end portion positioned frontward and upward of the connecting portion 56 with a space formed therebetween.

The partitioning portion 60 has a rear face having a generally central portion in the vertical direction, and the flat plate portion 61 is continuous with and extending rearward from the central portion of the partitioning portion 60. The flat plate portion 61 has a generally rectangular plate shape elongated in the leftward/rightward direction in a plan view.

The contact portion 62 is disposed on a lower face of an upper wall of the bulged portion 58, and protrudes downward from the upper wall of the bulged portion 58. The contact portion 62 has a generally rectangular plate shape elongated in the frontward/rearward direction in a plan view. The contact portion 62 has a rear end portion connected with a front face of the partitioning portion 60 and has a front end portion rearward of and adjacent to the front wall 36.

The contact portion 62 is bent or curved in a side view and defines a contact recessed portion 63 on its lower surface. The contact recessed portion 63 has a generally curved shape that is recessed or concaved toward upward from the front and rear edges of the contact portion 62 in a side view.

The contact recessed portion 63 includes a first slant portion 63A, a curved portion 63B, and a second slant portion 63C. The first slant portion 63A is a rear portion of the contact recessed portion 63. The first slant portion 63A is continuous with and linearly extending upward and frontward from the lower end portion of the partitioning portion 60 in a side view. The curved portion 63B extends from a front end portion of the first slant portion 63A and is curved toward frontward and downward in a side view. The second slant portion 63C is continuous with and linearly extending frontward and downward from a front end portion of the curved portion 63B in a side view.

In the side cross-sectional view of the housing 2, an imaginary line L1 is defined as connecting the lower end portion of the partitioning portion 60 and an upper end portion of the connecting portion 56. A space rearward of the imaginary line L1 defines the developing chamber 8 as an example of a second accommodating chamber. A space frontward of the imaginary line L1 defines the toner accommodating chamber 7 as an example of a first accommodating chamber. The toner accommodating chamber 7 accommodates toner supplied through the toner supply opening (now shown).

The upper end portion of the partitioning portion 60, a left face of the right side wall 34, and a right face of the left side wall 33 encompass a communication hole 64, which is an example of an opening portion.

That is, the housing 2 includes the toner accommodating chamber 7, the developing chamber 8, and the communication hole 64. The toner accommodating chamber 7 and the developing chamber 8 are adjacent to each other in the frontward/rearward direction, and the communication hole 64 provides communication between the toner accommodating chamber 7 and the developing chamber 8 in the frontward/rearward direction.

(2) Developing Chamber

More specifically, the developing chamber 8 is encompassed by a rear portion of the right side wall 34, a rear portion of the left side wall 33, the arcuate portion 42 and the lip portion 43 of the bottom wall 35, and the partitioning portion 60 and the flat plate portion 61 of the upper wall 37.

The developing cartridge 1 includes the developing roller 4, supply roller 5, and thickness regulation blade 6 in the developing chamber 8.

The developing roller 4 is disposed in a rear end portion of the developing chamber 8. The developing roller 4 includes a developing roller shaft 11 and a rubber roller 12.

The developing roller shaft 11 has a generally columnar shape extending in the leftward/rightward direction. The rubber roller 12 has a generally cylindrical shape and covers the developing roller shaft 11 so that left and right end portions of the developing roller shaft 11 are uncovered.

The developing roller 4 is supported by the housing 2. Specifically, the left and right end portions of the developing roller shaft 11 are rotatably supported by the right side wall 34 and the left side wall 33. The left end portion of the developing roller shaft 11 protrudes leftward from the left side wall 33, as shown in FIG. 3A.

The supply roller 5 is positioned frontward and downward of the developing roller 4 in the developing chamber 8, as shown in FIG. 6A. The supply roller 5 is accommodated in the arcuate portion 42 and includes the supply roller shaft 13 and a sponge roller 14.

The supply roller shaft 13 has a generally columnar shape extending in the leftward/rightward direction. The sponge roller 14 has a generally cylindrical shape and covers the supply roller shaft 13 so that left and right end portions of the supply roller shaft 13 are uncovered.

The left and right end portions of the supply roller shaft 13 are rotatably supported by the right side wall 34 and the left side wall 33. That is, the supply roller 5 is supported by the housing 2. The left end portion of the supply roller shaft 13 protrudes leftward from the left side wall 33, as shown in FIG. 3A.

The thickness regulation blade 6 is positioned frontward and upward of the developing roller 4 in the developing chamber 8, as shown in FIG. 6A. The thickness regulation blade 6 has a generally rectangular plate shape extending in the leftward/rightward direction in a rear side view, as shown in FIG. 1. The thickness regulation blade 6 is supported by the housing 2 such that the thickness regulation blade 6 has a lower end portion in contact with a front end portion of a peripheral surface of the rubber roller 12, as shown in FIG. 6A.

(3) Toner Accommodating Chamber

More specifically, the toner accommodating chamber 7 is encompassed by a front portion of the right side wall 34, a front portion of the left side wall 33, the front wall 36, the curved portion 41 of the bottom wall 35, and the bulged portion 58 and the partitioning portion 60 of the upper wall 37.

The developing cartridge 1 includes the agitator 3 in the toner accommodating chamber 7. Here, in the following description, "outward in a radial direction" refers to a direction away from the central axis of a member in a radial direction of that member, while "inward in a radial direction" refers to a direction toward the central axis of a member in the radial direction of that member.

Figures 12A, 12B:
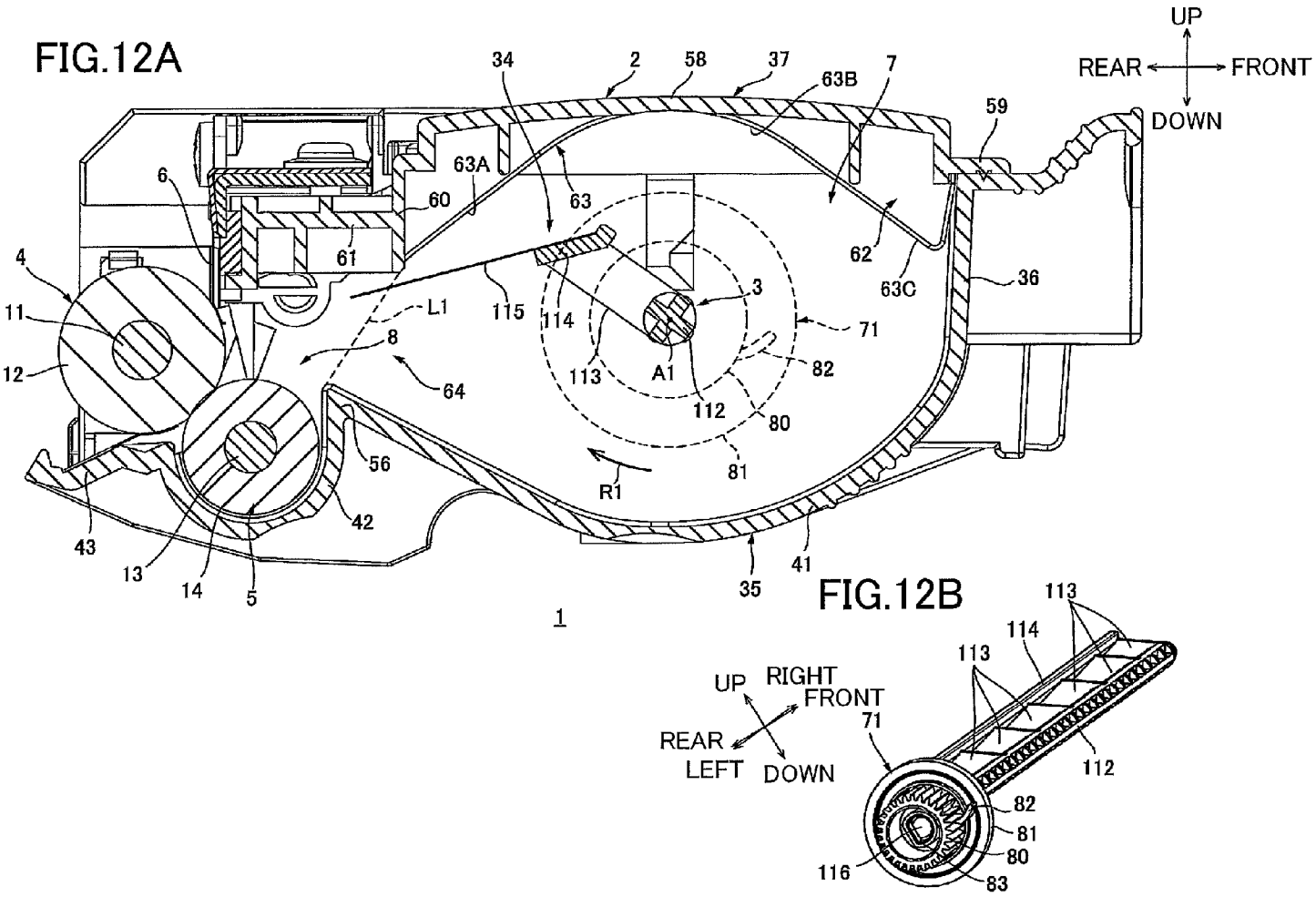
FIG. 12A is a center cross-sectional view of the developing cartridge shown in FIG. 11.
FIG. 12B is a perspective view of the agitator shown in FIG. 12A and the agitator gear as viewed from left-front side.

The agitator 3 is disposed in a generally central portion of the toner accommodating chamber 7 in a side view. The agitator 3 has an agitator shaft 112 as an example of a rotating shaft, a plurality of coupling plates 113, a blade fixing portion 114, and an agitation blade 115, as shown in FIGS. 12A and 12B.

The agitator shaft 112 is made from resin, e.g. acrylonitrile-butadiene-styrene copolymerization synthetic resin (ABS resin), and the agitator shaft 112 is resilient. The agitator shaft 112 has a generally columnar shape extending in the leftward/rightward direction. The agitator shaft 112 has a length in the leftward/rightward direction longer than the distance between the right side wall 34 and the left side wall 33 in the leftward/rightward direction.

Figure 11:
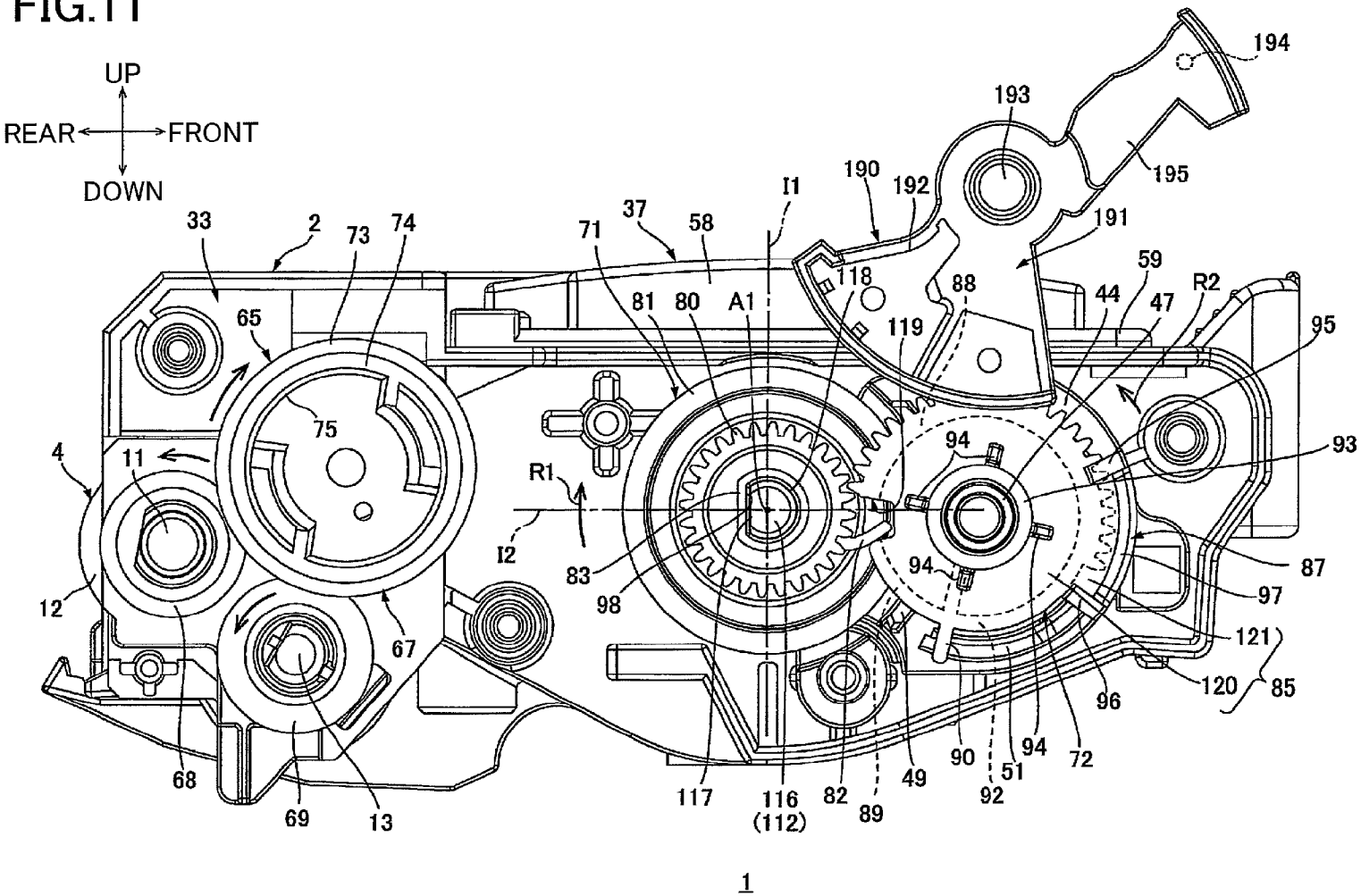
FIG. 11 is an explanatory diagram illustrating the new product detecting operation performed subsequent to the operation illustrated in FIG. 9, in which the detection gear is in a driving force transmission position.

The agitator shaft 112 has a left end portion that constitutes a gear attachment portion 116 as an example of a reference portion, as shown in FIG. 11.

The gear attachment portion 116 has a generally D-shape, in a left side view, which is formed by partially cutting away a peripheral surface of the agitator shaft 112. The gear attachment portion 116 has a flat surface 117 and an arcuate surface 118.

The flat surface 117 constitutes a chord corresponding to an arc portion having a central angle of approximately 90 within the entire peripheral surface of the agitator shaft 112. The flat surface 117 extends in the leftward/rightward direction. The arcuate surface 118 is part of the peripheral surface of the agitator shaft 112 excluding the flat surface 117. Specifically, the arcuate surface 118 is an arc portion having a central angle of approximately 270 degrees.

As shown in FIGS. 6B and 12B, the plurality of coupling plates 113 are eight coupling plates 113. The eight coupling plates 113 are arranged in the leftward/rightward direction and spaced apart from one another at equal intervals. As shown in FIG. 12A, each coupling plate 113 extends outward in a radial direction of the agitator shaft 112 from a portion of the outer peripheral surface of the agitator shaft 112.

The blade fixing portion 114 is supported on the radially outer end portions of the eight coupling plates 113. As shown in FIG. 12B, the blade fixing portion 114 has a plate shape extending in the leftward/rightward direction. In a side view as shown in FIG. 12A, the blade fixing portion 114 slopes toward the agitator shaft 112 while proceeding downstream in the rotational direction R1. The plate-shaped blade fixing portion 114 has a pair of opposite surfaces, one of which is a radially inner surface that faces inward in the radial direction of the agitator 3 and the other of which is a radially outer surface that faces outward in the radial direction of the agitator 3. The radially inner surface of the blade fixing portion 114 is connected with the radially outer end portions of the eight coupling plates 113.

The agitation blade 115 is formed of a flexible film material such as the polyethylene terephthalate (PET). The agitation blade 115 has a rectangular shape extending in the leftward/rightward direction. The agitation blade 115 has a length in the leftward/rightward direction substantially equal to the length of the blade fixing portion 114 in the leftward/rightward direction.

The agitation blade 115 is supported by the blade fixing portion 114 by fixing a radially inner end portion of the agitation blade 115 to the radially outer surface of the blade fixing portion 114 along the lengths of the agitation blade 115 and blade fixing portion 114 in the leftward/rightward direction. In this manner, the agitation blade 115 is supported by the agitator shaft 112 via the blade fixing portion 114 and the coupling plates 113. In a state where the agitation blade 115 is out of contact with the housing 2, as shown in FIG. 12A, the agitation blade 115 slopes toward the agitator shaft 112 while proceeding downstream in the rotational direction R1, similarly to the blade fixing portion 114. The agitator 3 includes only one agitation blade 115. The agitation blade 115 has a radial length defined between its radially inner edge (base edge) and its radially outer edge (distal edge). The radial length of the agitation blade 115 has such a size that at any given time during rotation of the agitator 3, as shown in FIGS. 6A, 8A, 10A, and 12A, the agitation blade 115 can occupy only an angular range of smaller than or equal to 180 degrees within the entire angular range of 360 degrees around the agitator shaft 112. So, while the agitator 3 is rotating in the rotation direction R1, the agitation blade 115 is always disposed within only an angular range of 180 degrees in the entire rotating range of 360 degrees of the agitator 3.

The agitator 3 is supported by the housing 2 with the left and right end portions of the agitator shaft 112 being rotatably supported by the right side wall 34 and the left side wall 33.

The gear attachment portion 116 positioned at the left end portion of the agitator shaft 112 protrudes leftward from the left side wall 33 as shown in FIG. 11.

Although details of the agitator 3 will be described later, upon receipt of a drive force, the agitator 3 rotates about the center axis A1 of the agitator shaft 112 in the rotational direction R1. The rotational direction R1 is a clockwise direction in a left side view as shown in FIG. 12A. While the agitator 3 is rotating, the agitation blade 115 contacts to and separates from the housing 2 alternately. The agitator shaft 112 resiliently deforms and resiliently restores its original shape due to the contact and separation of the agitation blade 115 relative to the housing 2.

(4) Detection Unit

Figure 4A:
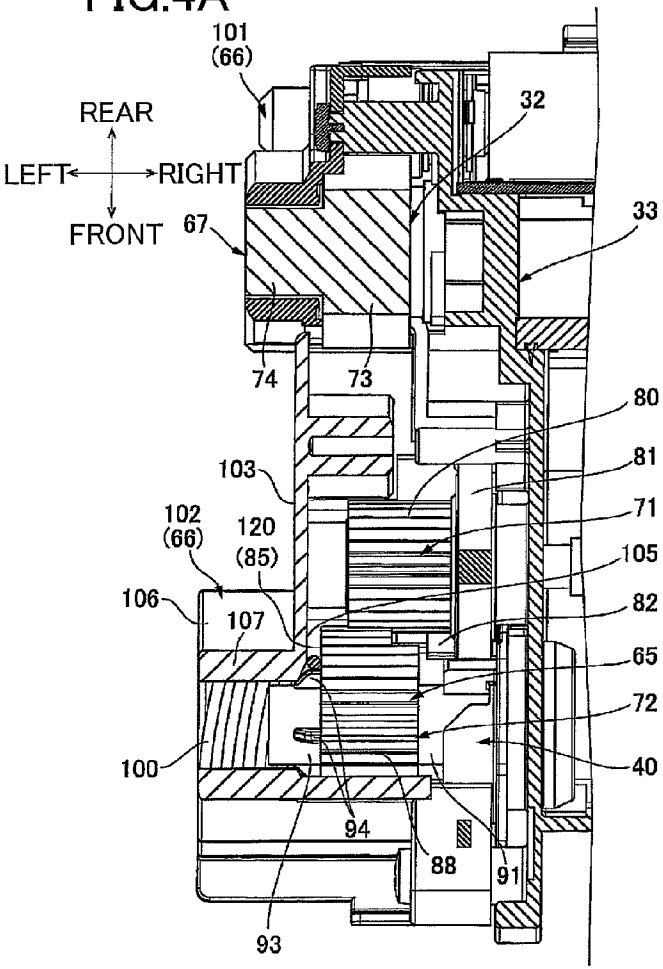
FIG. 4A is a horizontal cross-sectional view of a detection unit illustrated in FIG. 1.

As shown in FIGS. 1 and 4A, the detection unit 32 is disposed on the left side of the left side wall 33. The detection unit 32 includes a gear train 65, a spring member 100, and a cover member 66.

(4-1) Gear Train

As shown in FIG. 3A, the gear train 65 includes a development coupling 67, a developing roller gear 68, a supply roller gear 69, an idle gear 70, an agitator gear 71 serving as an example of a second rotary member, and a detection gear 72 serving as an example of a first rotary member.

(4-1-1) Development Coupling, Developing Roller Gear, Supply Roller Gear, and Idle Gear The development coupling 67 is provided on the left surface of the left side wall 33 near a rear end thereof. The development coupling 67 is rotatably supported on a rotational shaft (not shown). The rotational shaft is oriented in the leftward/rightward direction and fixed in the left side wall 33 so as to be incapable of rotating relative to the left side wall 33.

The development coupling 67 has a general columnar shape that is elongated in the leftward/rightward direction. The development coupling 67 is integrally provided with a coupling gear portion 73 and a coupling portion 74. The coupling gear portion 73 constitutes a right portion of the development coupling 67. Gear teeth are formed around an entire circumferential surface of the coupling gear portion 73. The coupling portion 74 constitutes a left portion of the development coupling 67. The coupling portion 74 has a general columnar shape that is arranged coaxially with the coupling gear portion 73. The coupling portion 74 has a smaller outer diameter than the coupling gear portion 73.

A coupling recessed portion 75 is formed in a left endface of the coupling portion 74. A main coupling 200 described later is inserted in the coupling recessed portion 75 so as to be incapable of rotating relative to the main coupling 200. The coupling recessed portion 75 has a general circular shape in a side view and is recessed rightward from the left endface of the coupling portion 74.

The developing roller gear 68 is disposed on the lower rear side of the development coupling 67. The developing roller gear 68 has a general cylindrical shape that is oriented in the leftward/rightward direction. Gear teeth are formed around an entire circumferential surface of the developing roller gear 68. The developing roller gear 68 is mounted on the left end portion of the developing roller shaft 11 so as to be incapable of rotating relative to the developing roller shaft 11. The developing roller gear 68 is intermeshed with the coupling gear portion 73.

The supply roller gear 69 is disposed below the development coupling 67. The supply roller gear 69 has a general cylindrical shape that is elongated in the leftward/rightward direction. Gear teeth are formed on an entire circumferential surface of the supply roller gear 69. The supply roller gear 69 is mounted on the left end of the supply roller shaft 13 so as to be incapable of rotating relative to the supply roller shaft 13. The supply roller gear 69 is intermeshed with the coupling gear portion 73.

The idle gear 70 is disposed frontward of the development coupling 67. The idle gear 70 integrally includes a large diameter gear 77 and a small diameter gear 78.

The large diameter gear 77 is disposed on the left end portion of the idle gear 70. The large diameter gear 77 has a general annular plate shape having a thickness in the leftward/rightward direction. Gear teeth are formed around an entire circumferential surface of the large diameter gear 77.

The small diameter gear 78 has a general cylindrical shape that is coaxial with the large diameter gear 77. The small diameter gear 78 protrudes rightward from the large diameter gear 77. The small diameter gear 78 has an outer diameter smaller than the outer diameter of the large diameter gear 77. Gear teeth are formed around an entire circumferential surface of the small diameter gear 78.

The idle gear 70 is rotatably supported on the left side wall 33 so as to rotate about a center axis. A rear end portion of the large diameter gear 77 is intermeshed with a front end portion of the coupling gear portion 73.

(4-1-2) Agitator Gear 71

The agitator gear 71 is disposed on the lower front side of the idle gear 70. As shown in FIGS. 3A and 5, the agitator gear 71 is a double gear and integrally includes a first gear portion 81 and a second gear portion 80.

As shown in FIG. 3A, the first gear portion 81 constitutes a right portion of the agitator gear 71 and has a general circular plate shape. Gear teeth are formed around an entire circumferential surface of the first gear portion 81.

As shown in FIG. 5, the first gear portion 81 has an attachment hole 98 at an approximate center region of the first gear portion 81 in a side view. The first gear portion 81 has a D-shape whose size is substantially equal to that of the gear attachment portion 116. The attachment hole 98 penetrates the first gear portion 81 in the leftward/rightward direction.

As shown in FIG. 3A, the second gear portion 80 constitutes a left portion of the agitator gear 71 and is adjacent to the left side of the first gear portion 81. In other words, the first gear portion 81 and second gear portion 80 are arranged in this order in the first direction X or leftward direction such that the second gear portion 80 is positioned farther away from the left side wall 33 than the first gear portion 81 is from the left side wall 33 in the leftward/rightward direction.

The second gear portion 80 has a general cylindrical shape and positioned coaxially with the first gear portion 81. The second gear portion 80 protrudes leftward from the left surface of the first gear portion 81. The second gear portion 80 encompasses the attachment hole 98 in a side view. The second gear portion 80 has an outer diameter smaller than that of the first gear portion 81. Gear teeth are formed around an entire circumferential surface of the second gear portion 80.

As shown in FIG. 5, the agitator gear 71 further includes an abutment plate 82 serving as an example of the second abutment portion, and an attachment sleeve 83.

As shown in FIG. 4A, the abutment plate 82 is provided on the left surface of the first gear portion 81 and is positioned radially outward with respect to the second gear portion 80. The abutment plate 82 is a plate shape protruding leftward from the left surface of the first gear portion 81. As shown in FIG. 5, the abutment plate 82 slopes inward in the radial direction of the first gear portion 81 while progressing downstream in the rotational direction R1 of the agitator gear 71. The radially inner end of the abutment plate 82 is connected to the outer peripheral surface of the second gear portion 80 at a right end portion of the second gear portion 80.

The attachment sleeve 83 is provided on the left surface of the first gear portion 81, and is disposed within the second gear portion 80. The attachment sleeve 83 is of a cylindrical shape extending in the leftward/rightward direction and protrudes leftward from a peripheral edge of the attachment hole 98. The attachment sleeve 83 is generally D-shaped in a side view.

The agitator gear 71 is attached to the gear attachment portion 116 of the agitator shaft 112 such that the attachment hole 98 of the first gear portion 81 and the attachment sleeve 83 receive therein the gear attachment portion 116 so as to be incapable of rotating relative to the gear attachment portion 116. Thus, the agitator gear 71 is supported to the gear attachment portion 116 of the agitator shaft 112, and is rotatable relative to the left side wall 33 in the rotational direction R1 about the center axis A1 of the agitator shaft 112.

In a state where the agitator gear 71 is attached to the gear attachment portion 116, when viewed in the leftward/rightward direction, as shown in FIG. 12A, the abutment plate 82 is disposed upstream of the blade fixing portion 114 in the rotational direction R1, with an angular interval of, for example, 170 to 190 degrees, more specifically 180 degrees being formed therebetween. Thus, the gear attachment portion 116 functions as a positioning reference for determining relative angular positions between the agitation blade 115 supported to the blade fixing portion 114 and the abutment plate 82 of the agitator gear 71 in the rotational direction R1.

As shown in FIG. 3A, the first gear portion 81 of the agitator gear 71 has a rear end portion meshedly engaged with a front end portion of the small diameter gear 78 of the idle gear 70.

Incidentally, during rotation of the agitator 3, the agitator gear 71 is rotated eccentrically due to resilient deformation and restoration of the agitator shaft 112.

However in a state where the flat surface 117 of the gear attachment portion 116 faces rearward and extends vertically as shown in FIG. 11, the agitation blade 115 is spaced apart from the housing 2 as shown in FIG. 12A, and therefore the agitator shaft 112 is not resiliently deformed.

A first imaginary line I1 and a second imaginary line I2 are additionally indicated in FIGS. 5, 7, 9 and 11, in order to describe how the agitator gear 71 is decentered during rotation of the agitator 3 with respect to a reference position, at which position the agitator shaft 112 is not resiliently deformed. Both of the first imaginary line I1 and second imaginary line I2 are defined as being located at fixed positions and fixed orientations relative to the developing cartridge 1 such that the first imaginary line I1 extends in the vertical direction, the second imaginary line I2 extends in the frontward/rearward direction, and the center axis A1 of the agitator shaft 112 is located on both of the first imaginary line I1 and second imaginary line I2 when the agitator shaft 112 is not resiliently deformed as shown in FIG. 11.

(4-1-3) Detection Gear

The detection gear 72 is disposed frontward of agitator gear 71. As shown in FIGS. 9 through 14B, due to drive force transmitted from the agitator gear 71, the detection gear 72 is irreversibly rotated in a rotational direction R2 from an initial position to a terminal position. The initial position is an example of a first position. The rotational direction R2 is a counterclockwise direction in a left side view.

The following description of the detection gear 72 will be based on a state of the detection gear 72 in its initial position shown in FIGS. 1, 3A, 4A through 5, 7 and 9.

The detection gear 72 is made from a known plastic material. As shown in FIGS. 3A and 4B, the detection gear 72 is an integral component including a plate-like portion 85, a shaft insertion portion 91, a driving force receiving portion 84, a spring support portion 86 and a detected portion 87.

The plate-like portion 85 integrally includes a main portion 120 and an extension portion 121 as shown in FIG. 5.

The main portion 120 is generally circular in a side view. The extension portion 121 protrudes radially outward from a front lower part of the circumferential surface of the main portion 120 that has a center angle of approximately 45 degrees. The extension portion 121 is generally sector shaped in a side view, and is positioned with its center of curvature being coincident with the center axis of the main portion 120.

As shown in FIG. 4B, the shaft insertion portion 91 is provided on a right surface of the main portion 120 of the plate-like portion 85. The shaft insertion portion 91 is of a generally cylindrical shape and is positioned coaxially with the main portion 120. The shaft insertion portion 91 protrudes rightward from a radially intermediate region of the main portion 120. The shaft insertion portion 91 has an inner diameter approximately equal to an outer diameter of the detection gear support shaft 47.

The driving force receiving portion 84 is provided at the right surface of the plate-like portion 85, and integrally includes a detection gear portion 88 as an example of a gear teeth portion, a guide rib 90, a connecting portion 92, and a detection abutment portion 89 as an example of a first abutment portion as shown in FIG. 5.

The detection gear portion 88 is generally of a semi-cylindrical shape and is positioned coaxially with the main portion 120 of the plate-like portion 85. The semi-cylindrical detection gear portion 88 is open toward downward and rearward in a side view. The detection gear portion 88 protrudes rightward from the right surface of the main portion 120 as shown in FIG. 4B.

An inner peripheral surface of the detection gear portion 88 has a radius of curvature greater than an outer radius of the shaft insertion portion 91, and an outer peripheral surface of the detection gear portion 88 has a radius of curvature approximately equal to an outer radius of the main portion 120 of the plate-like portion 85 as shown in FIG. 5.

The detection gear portion 88 has an entire part of its outer peripheral surface formed with gear teeth. A gear tooth that is located on the upstream end of the detection gear portion 88 in the rotational direction R2 is disposed rightward of and adjacent to the extension portion 121.

As shown in FIGS. 3A and 4B, the detection gear portion 88 is formed with a notched portion 99. The notched portion 99 is formed in a right portion of the detection gear portion 88 at the downstream end in the rotational direction R2. The notched portion 99 is generally of a rectangular shape in a rear side view. The notched portion 99 is formed by cutting away the right portion of the detection gear portion 88 at the downstream end in the rotational direction R2.

As shown in FIGS. 4B and 5, the guide rib 90 is disposed below and rearward of the shaft insertion portion 91. The guide rib 90 is generally of a plate shape that extends in a radial direction of the detection gear 72 as shown in FIG. 5. The guide rib 90 has a dimension in the radial direction longer than the outer radius of the main portion 120 in the plate-like portion 85. As shown in FIG. 4B, the dimension in the leftward/rightward direction of the guide rib 90 is longer than the dimension in the leftward/rightward direction of the detection gear portion 88.

The guide rib 90 has a radially inner end portion that is coupled to the rear lower end portion of the shaft insertion portion 91. As shown in FIG. 5, the radially outer end portion of the guide rib 90 protrudes radially outwardly relative to the outer peripheral edge of the main portion 120. The left end of the guide rib 90 is coupled, at its radially inner side portion, to the right surface of the main portion 120 in the plate-like portion 85.

As shown in FIG. 4B, the right end portion of the guide rib 90 constitutes a slide portion 122. The slide portion 122 is chamfered into a semi-circular arc shape with its convex side facing rightward when viewed in a longitudinal direction of the guide rib 90 aligned with the radial direction of the detection gear 72.

As shown in FIG. 5, the connecting portion 92 is disposed below and frontward of the shaft insertion portion 91 with a gap formed therebetween. The connecting portion 92 connects a radial central portion on the front surface of the guide rib 90 to the upstream end of the detection gear portion 88 in the rotational direction R2, while following the rotational direction R2. As shown in FIG. 4B, the connecting portion 92 protrudes rightward from the right surface of the main portion 120. The leftward/rightward dimension of the connecting portion 92 is approximately the same as the leftward/rightward dimension of the detection gear portion 88.

The detection abutment portion 89 is disposed below and rearward of the shaft insertion portion 91 with a gap formed therebetween. The detection abutment portion 89 is disposed upstream of the guide rib 90 in the rotational direction R2. As shown in FIG. 5, the detection abutment portion 89 is generally of an arc-shape in a side view and extends from approximately a radial central region on the guide rib 90 toward upstream in the rotational direction R2. As shown in FIG. 4B, the detection abutment portion 89 protrudes rightward from the right surface of the main portion 120 in the plate-like portion 85. The leftward/rightward dimension of the detection abutment portion 89 is longer than the leftward/rightward dimension of the detection gear portion 88 but is smaller than the leftward/rightward dimension of the guide rib 90.

The upstream end portion of the detection abutment portion 89 in the rotational direction R2 is disposed to oppose the downstream end portion of the detection gear portion 88 in the rotational direction R2 with a gap formed therebetween, as shown in FIG. 5. The gap between the detection abutment portion 89 and the detection gear portion 88 in the rotational direction R2 is defined as a slit 119, which is an example of a tooth lacking portion. That is, the drive force is unable to be transmitted to the slit 119.

As shown in FIG. 3A, the spring support portion 86 is provided on a left surface of the main portion 120 of the plate-like portion 85. The spring support portion 86 includes a boss 93, and a plurality of engagement protrusions 94.

The boss 93 has a general cylindrical shape and is positioned coaxially with the main portion 120 of the plate-like portion 85. The boss 93 protrudes leftward from the main portion 120 at approximately a radial center region thereof.

The plurality of engagement protrusions 94 are four engagement protrusions 94 which are arranged at approximately 90-degree intervals around a circumference of the boss 93. As shown in FIG. 5, each engagement protrusion 94 has a general rectangular shape in a side view and protrudes radially outward from an outer peripheral surface of the boss 93. As shown in FIG. 3A, the right end of each engagement protrusion 94 is connected to the left surface of the main portion 120.

As shown in FIG. 5, the detected portion 87 is disposed on the left surface of the extension portion 121 of the plate-like portion 85. The detected portion 87 includes a first detected protrusion 95, a second detected protrusion 96, and a coupling portion 97.

The first detected protrusion 95 is disposed on the front side of the boss 93 with a gap formed therebetween. In a side view, the first detected protrusion 95 is elongated in a radial direction of the detection gear 72, and has a radially outer edge coincident with the outer circumferential edge of the extension portion 121.

As shown in FIG. 3A, the first detected protrusion 95 has a rail-like shape extending in the leftward/rightward direction, and protrudes leftward from the extension portion 121.

As shown in FIG. 5, the second detected protrusion 96 is disposed obliquely below and forward of the boss 93 with a gap formed therebetween. In a side view, the second detected protrusion 96 is elongated in a radial direction of the detection gear 72 and has a radially outer edge coincident with the outer circumferential edge of the extension portion 121.

As shown in FIG. 3A, the second detected protrusion 96 has a rail-like shape extending in the leftward/rightward direction and protrudes leftward from the left surface of the extension portion 121. The second detected protrusion 96 has a left-right dimension approximately the same as that of the first detected protrusion 95.

As shown in FIG. 5, the coupling portion 97 is disposed between the first detected protrusion 95 and the second detected protrusion 96. The coupling portion 97 extends in the rotational direction R2 and connects the radial outer portion of the first detected protrusion 95 with the radial outer portion of the second detected protrusion 96.

As shown in FIG. 3A, the coupling portion 97 has a plate-like shape extending in the leftward/rightward direction and protrudes leftward from the left surface of the extension portion 121. The coupling portion 97 has a shorter left-right dimension than that of the first detected protrusion 95.

As shown in FIGS. 4B and 5, the detection gear 72 is supported on the left side wall 33 through the cap 40, with the shaft insertion portion 91 receiving therein the detection gear support shaft 47 so as to be capable of rotating relative to the detection gear support shaft 47. With this configuration, the detection gear 72 can rotate relative to the left side wall 33 about the center axis of the shaft insertion portion 91 in the rotational direction R2, as shown in FIG. 5.

(4-2) Spring Member

As shown in FIG. 4A, the spring member 100 is an air-core coil type spring that is elongated in the leftward/rightward direction. The spring member 100 is supported by the detection gear 72 in such a state that the boss 93 is inserted into the spring member 100 and the right end portion of the spring member 100 is anchored to the plurality of engagement protrusions 94.

The right end portion of the spring member 100 contacts the left surface of the main portion 120 of the plate-like portion 85, and the left end portion of the spring member 100 contacts the right surface of the left end portion of a spring retaining portion 107 described later. That is, the spring member 100 is interposed in the leftward/rightward direction between the plate-like portion 85 and the left end portion of the spring retaining portion 107 described later, and constantly urges the detection gear 72 rightward, i.e., toward the cap 40.

(4-3) Gear Cover

As shown in FIGS. 1 and 4A, the cover member 66 covers the left side of the gear train 65. The cover member 66 includes a first cover 101 and a second cover 102.

The first cover 101 covers the left side of the rear portion of the gear train 65, and more specifically the development coupling 67, developing roller gear 68, and supply roller gear 69. The first cover 101 has a box-like shape that is open on the right side and the front side.

The first cover 101 has a coupling exposure opening 104. The coupling exposure opening 104 is formed in a left wall of the first cover 101. The coupling exposure opening 104 has a general circular shape in a side view and penetrates the left wall of the first cover 101 in the leftward/rightward direction at an approximate center region thereof.

The first cover 101 is fastened to the rear portion of the left side wall 33 with screws. When fastened to the left side wall 33, the first cover 101 covers the coupling portion 74 of the development coupling 67, the developing roller gear 68, and the supply roller gear 69 in their entirety while the coupling recessed portion 75 of the development coupling 67 is exposed through the coupling exposure opening 104.

The second cover 102 covers the left side of the front portion of the gear train 65, and more specifically the idle gear 70, agitator gear 71, and detection gear 72. The second cover 102 has a box-like shape that is open on the right side and the rear side.

Specifically, the second cover 102 has a cover plate 103, a peripheral wall 111, a circumferential wall 106, the spring retaining portion 107, and a coupling portion 108.

As shown in FIG. 1, the cover plate 103 has a plate shape that is generally rectangular in a side view and elongated in the frontward/rearward direction. As shown in FIGS. 1 and 4A, the cover plate 103 has a through-hole 105. The through-hole 105 is disposed on a front end portion of the cover plate 103.

As shown in FIG. 1, the peripheral wall 111 protrudes rightward from the front, upper, and lower edges of the cover plate 103, and is continuous therefrom.

The circumferential wall 106 has a general cylindrical shape that is elongated in the leftward/rightward direction. The circumferential wall 106 protrudes leftward from a peripheral edge of the through-hole 105 of the cover plate 103.

The spring retaining portion 107 has a general cylindrical shape that is elongated in the leftward/rightward direction and closed on its left end. The spring retaining portion 107 is disposed inside the circumferential wall 106 and arranged coaxially with the same.

The coupling portion 108 is disposed in the circumferential wall 106 on the bottom of the spring retaining portion 107. The coupling portion 108 extends in a radial direction of the circumferential wall 106 and connects the outer circumferential surface of the spring retaining portion 107 with the inner circumferential surface of the circumferential wall 106.

A space defined by the inner circumferential surface of the circumferential wall 106, the outer circumferential surface of the spring retaining portion 107, and both front and rear surfaces of the coupling portion 108 will be called a detected portion insertion opening 109. The detected portion insertion opening 109 has a general C-shape in a side view with the opening of the "C" facing downward. The detected portion insertion opening 109 penetrates the second cover 102 in the leftward/rightward direction.

As illustrated in FIG. 4A, the second cover 102 is fastened to the front portion of the left side wall 33 with screws such that the spring retaining portion 107 receives the left end portion of the spring member 100 and such that the second cover 102 covers the idle gear 70, the agitator gear 71, and the detection gear 72 in their entirety.

With this configuration, as illustrated in FIG. 1, the detected portion 87 of the detection gear 72 is positioned inside the circumferential wall 106, and the left ends of the first detected protrusion 95 and the second detected protrusion 96 are positioned slightly rightward of the left end surface of the circumferential wall 106.

Further, as illustrated in FIG. 4A, the agitator gear 71 is positioned rightward of the cover plate 103 and spaced apart therefrom. That is, the agitator gear 71 is spaced apart from the cover plate 103 in the leftward/rightward direction.

4. Detailed Description of the Main Casing

As illustrated in FIGS. 1 and 11, the main casing 16 includes a main coupling 200 and a detection mechanism 190.

As illustrated in FIG. 1, in a state where the developing cartridge 1 is mounted in the main casing 16, the main coupling 200 is positioned leftward of the coupling recessed portion 75 of the development coupling 67 and spaced apart therefrom. The main coupling 200 has a general columnar shape extending in the leftward/rightward direction. The main coupling 200 has a right end portion having a shape that can be inserted into the coupling recessed portion 75.

The main coupling 200 is configured to move in the leftward/rightward direction in association with the opening and closing operations of the front cover 21 according to a known coupling mechanism. A drive source such as a motor (not illustrated) is provided in the main casing 16 for transmitting a drive force to the main coupling 200. Upon transmission of the drive source to the main coupling 200, the main coupling 200 starts rotating clockwise in a left side view.

Figure 13A:
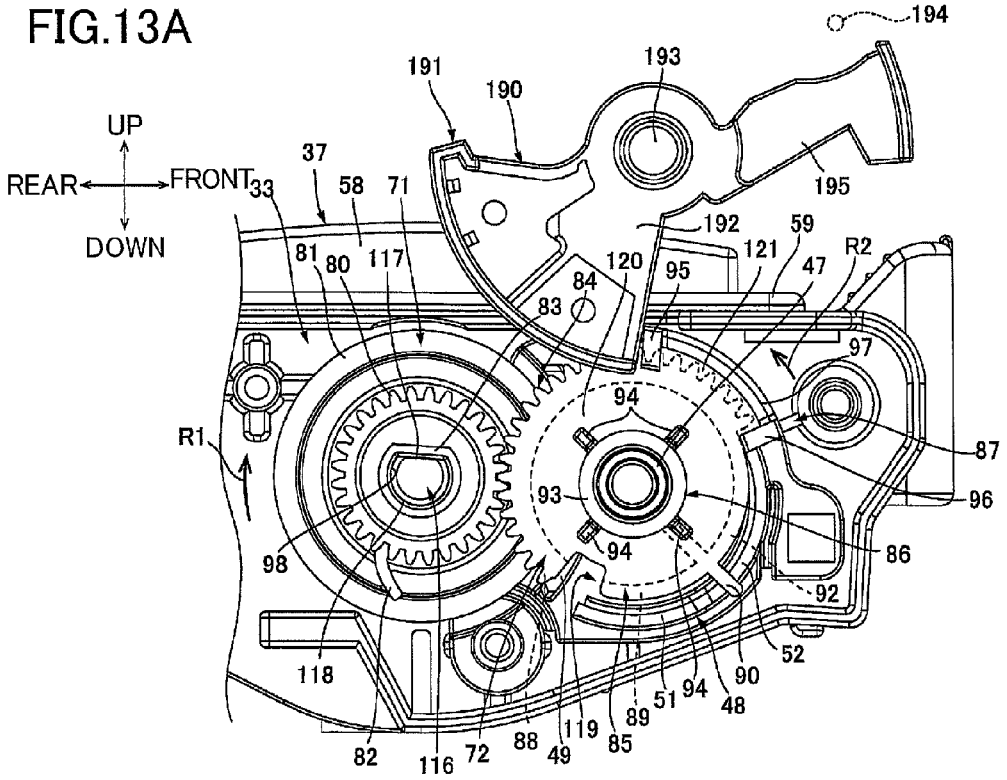
FIG. 13A is an explanatory diagram illustrating the new product detecting operation performed subsequent to the operation illustrated in FIG. 11, in which the detection gear is in a detection position.

As illustrated in FIG. 13A, the detection mechanism 190 is configured to detect the first detected protrusion 95 and the second detected protrusion 96. As illustrated in FIG. 11, in a state where the developing cartridge 1 is mounted in the main casing 16, the detection mechanism 190 is positioned upper-leftward of the detection gear 72 and spaced apart therefrom.

The detection mechanism 190 includes an actuator 191 and an optical sensor 194.

The actuator 191 includes a pivot shaft 193, an abutment lever 192 and a light shielding lever 195.

The pivot shaft 193 has a general columnar shape extending in the leftward/rightward direction. The pivot shaft 193 is rotatably supported in the main casing 16.

The abutment lever 192 is positioned lower-rearward of the pivot shaft 193. The abutment lever 192 has a general sector shape in a side view with a center angle of 90 degrees. A portion of the abutment lever 192 where the center angle of the sector shape is located is connected to the pivot shaft 193.

The light shielding lever 195 is positioned opposite to the abutment lever 192 with respect to the pivot shaft 193. In other words, the light shielding lever 195 is positioned diagonally above and frontward of the pivot shaft 193. The light shielding lever 195 has a general rectangular shape in a side view that extends in a direction sloping upward toward the front. The light shielding lever 195 has a lower-rear end portion connected to the pivot shaft 193.

The actuator 191 is pivotally movable between a non-detection position (FIG. 11) and a detection position (FIG. 13A). In the non-detection position, a front edge of the abutment lever 192 extends in a direction sloping downward toward the front. In the detection position, the front edge of the abutment lever 192 extends in a direction sloping downward toward the rear. The actuator 191 is constantly positioned in the non-detection position by an urging force of a spring (not illustrated).

The optical sensor 194 includes a light-emitting element and a light-receiving element of a well-known structure. The light-emitting element and the light-receiving element are positioned so as to be spaced apart from and in confrontation with each other in the leftward/rightward direction. The optical sensor 194 is positioned such that, as illustrated in FIG. 11, the light shielding lever 195 blocks a light path from the light-emitting element to the light-receiving element when the actuator 191 is at the non-detection position, and, as illustrated in FIG. 13A, the light shielding lever 195 is retracted from the light path from the light-emitting element to the light-receiving element when the actuator 191 is at the detection position.

The optical sensor 194 outputs an OFF signal when the actuator 191 is at the non-detection position and the light shielding lever 195 blocks the light path from the light-emitting element to the light-receiving element as illustrated in FIG. 11, and outputs an ON signal when the actuator 191 is at the detection position and the light shielding lever 195 is retracted from the light path from the light-emitting element to the light-receiving element as illustrated in FIG. 13A. While not illustrated in the drawings, a microcomputer is electrically connected to the optical sensor 194.

5. Operations for Mounting and Removing the Developing Cartridge Relative to the Main Casing and for Detecting Whether the Mounted Developing Cartridge is New

(1) Operations for Mounting the Developing Cartridge in the Main Casing

Figure 7:
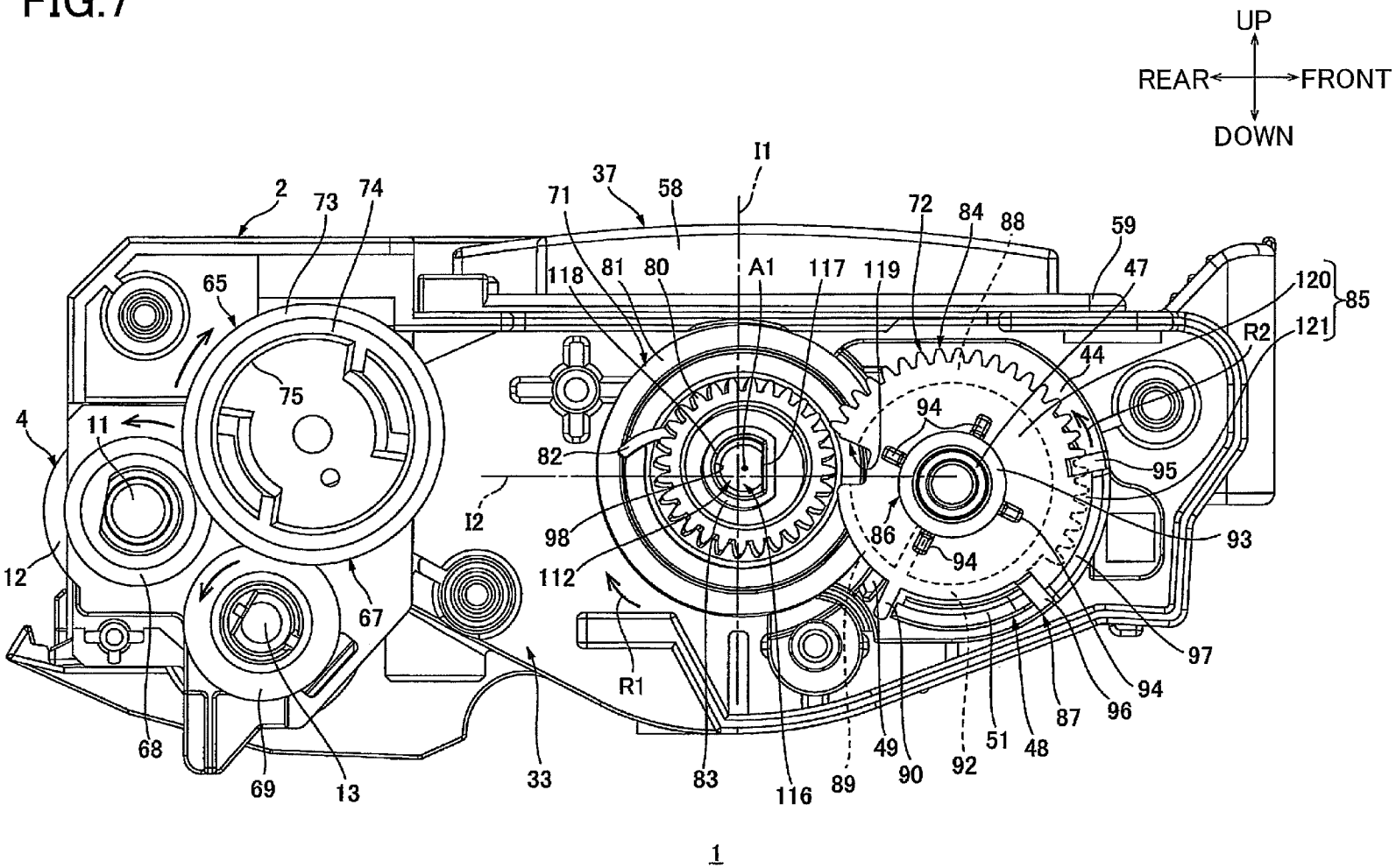
FIG. 7 is an explanatory diagram illustrating the new product detecting operation performed subsequent to the operation illustrated in FIG. 5, in which the detection gear is in the initial position and the flat surface of the gear attachment portion is oriented frontward.
Figure 9:
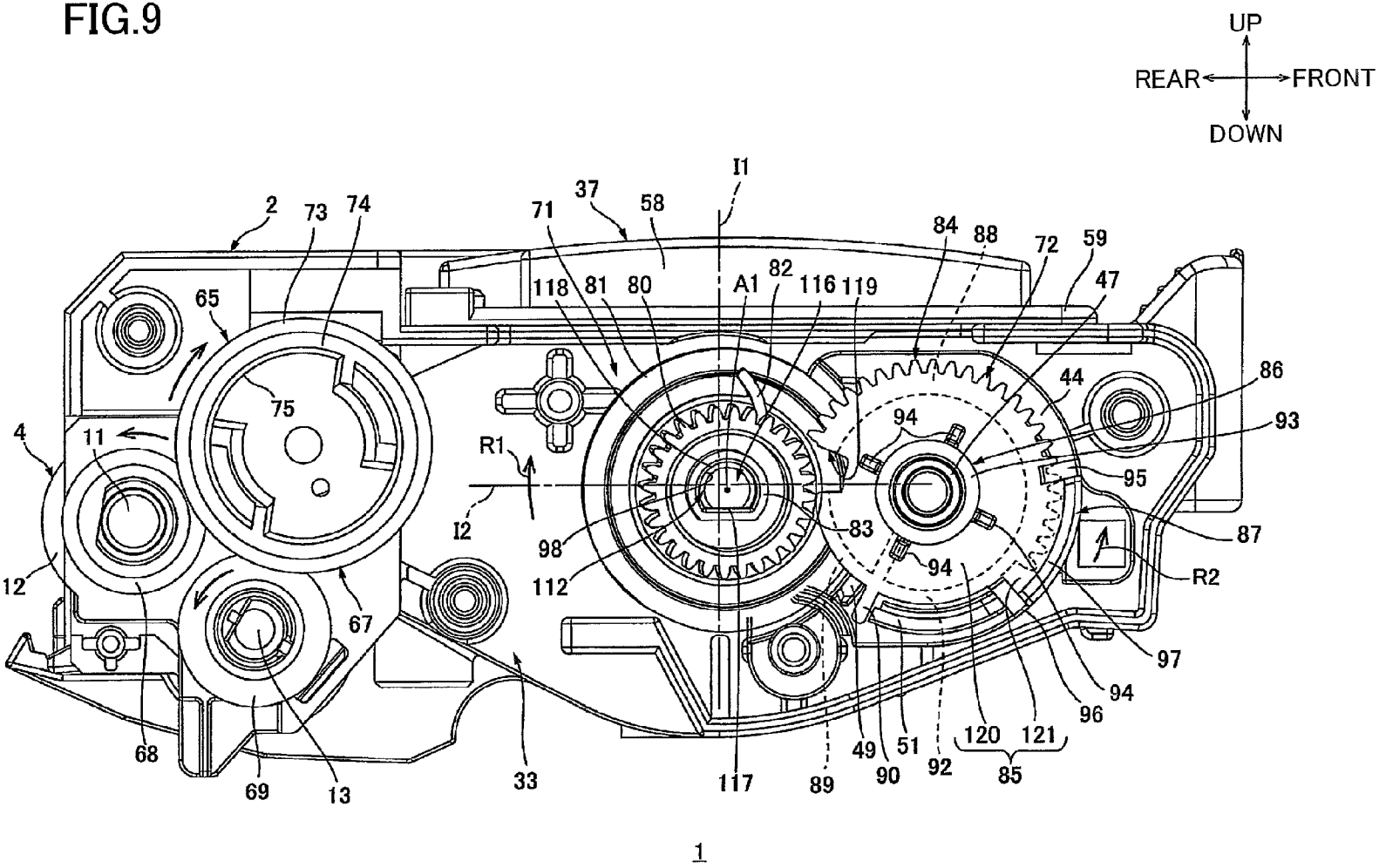
FIG. 9 is an explanatory diagram illustrating the new product detecting operation performed subsequent to the operation illustrated in FIG. 7, in which the detection gear is in the initial position and the flat surface of the gear attachment portion is oriented downward.

When the developing cartridge 1 is a new cartridge, that is, before the developing cartridge 1 is used for the first time, the detection gear 72 is at its initial position as illustrated in FIGS. 5, 7 and 9. The initial position of the detection gear 72 is its position prior to an operation being performed to rotate the detection gear 72.

In a state where the detection gear 72 is at the initial position, as illustrated in FIG. 5, the downstream end portion of the detection gear portion 88 in the rotational direction R2 is not meshingly engaged with the second gear portion 80 of the agitator gear 71, but is positioned above and frontward of the second gear portion 80 with a space therebetween. The slit 119 of the detection gear 72 is positioned frontward of the second gear portion 80. In other words, the slit 119 of the detection gear 72 at the initial position faces the second gear portion 80 of the agitator gear 71.

The detection abutment portion 89 is positioned so as to overlap with the first gear portion 81 as viewed from a left side. As illustrated in FIG. 4B, the detection abutment portion 89 is positioned leftward of the first gear portion 81 and spaced apart therefrom.

When the detection gear 72 is at the initial position, due to the urging force of the spring member 100, the detection gear 72 is placed at a most rightward position or a position closest to the left side wall 33 in the leftward/rightward direction, among all the positions at which the detection gear 72 can be placed. In this state, the right end of the shaft insertion portion 91 of the detection gear 72 and the slide portion 122 of the guide rib 90 are in contact with the left surface of the closure portion 44 of the cap 40.

The right portion of the guide rib 90 is positioned between the first stop 49 and the lower end of the guide portion 48 as illustrated in FIG. 4B. That is, the slide portion 122 of the guide rib 90 is positioned upstream of the first sloped surface 51 of the guide portion 48 in the rotational direction R2.

The detected portion 87 is positioned in the upstream end portion of the detected portion insertion opening 109 in the rotational direction R2 as viewed from the left side, as illustrated in FIG. 1.

In the present embodiment, as illustrated in FIG. 5, the agitator 3 of the new developing cartridge 1 is positioned such that the flat surface 117 of the gear attachment portion 116 faces upward and extends in the frontward/rearward direction.

With this arrangement, the coupling plates 113, the blade fixing portion 114, and the agitation blade 115 are positioned above the agitator shaft 112 as illustrated in FIG. 6A, and the radially outer end portion of the agitation blade 115 is in contact with the curved portion 63B of the contact portion 62. Hence, the agitation blade 115 is deformed or warped against resiliency of the agitation blade 115 such that the radially outer edge (distal end) of the agitation blade 115 points or faces toward upstream in the rotational direction R1.

The radially outer end portion of the agitation blade 115 presses the curved portion 63B outward in the radial direction of the agitation blade 115. A reaction force F1 generated in response to the pressing force of the agitation blade 115 is applied to the agitation blade 115 to press the agitation blade 115 inward in the radial direction, more specifically, downward and frontward. The agitator shaft 112 is thus pressed downward and frontward through the agitation blade 115, the blade fixing portion 114, and the coupling plates 113. As a result, the agitator shaft 112 is resiliently deformed such that a left-right center portion thereof is bent toward downward and frontward. This causes the gear attachment portion 116 of the agitator shaft 112 and the agitator gear 71 to position slightly upward and rearward as illustrated in FIG. 5 in comparison with the case where the agitation blade 115 is out of contact with the housing 2.

In other words, in a state where the agitation blade 115 is in contact with the curved portion 63B as illustrated in FIG. 6A, the center axis A1 of the agitator shaft 112 is positioned rearward of the first imaginary line I1 and upward of the second imaginary line I2.

To mount a new developing cartridge 1 having this configuration in the main casing 16, a user opens the front cover 21 and inserts the developing cartridge 1 into the main casing 16 through the access opening 20 from a front side thereof. Subsequently, the user closes the front cover 21.

This completes the operation for mounting the developing cartridge 1 in the main casing 16.

2) Operation for Detecting Whether the Developing Cartridge is New

Next, an operation for detecting the developing cartridge 1 will be described while referring to FIGS. 5 through 14B. For the sake of simplicity, showing of the idle gear 70, the cover member 66, and the spring member 100 is omitted in FIGS. 4A, 5, 7, 9, 11, 13A, and 14A, and showing of the detection mechanism 190 is further omitted in FIGS. 5, 7, and 9.

When the user closes the front cover 21, through the known coupling mechanism (not illustrated), the main coupling 200 provided in the main casing 16 is inserted into the coupling recessed portion 75 of the coupling portion 74, as illustrated in FIG. 1, so as to be incapable of rotating relative to the coupling recessed portion 75. Subsequently, the control unit (not illustrated) provided in the main casing 16 initiates a warm-up operation for the printer 15.

In the warm-up operation, the main coupling 200 inputs a drive force to the development coupling 67, causing the development coupling 67 to rotate clockwise in a left side view. At this time, as illustrated in FIG. 3A, the development coupling 67 transmits the drive force to various gears engaged with the coupling gear portion 73.

When the drive force is transmitted to the developing roller gear 68 and the supply roller gear 69, the developing roller 4 rotates counterclockwise in a left side view owing to the drive force transmitted to the developing roller gear 68, and the supply roller 5 rotates counterclockwise in a left side view owing to the drive force transmitted to the supply roller gear 69, as illustrated in FIG. 2.

When the drive force is transmitted to the idle gear 70, the idle gear 70 rotates counterclockwise in a left side view as illustrated in FIG. 3A and transmits the drive force to the first gear portion 81 of the agitator gear 71 engaged with the small diameter gear 78.

When the drive force is transmitted to the first gear portion 81, the agitator gear 71 and the agitator 3 rotates together in the rotational direction R1, as illustrated in FIGS. 5 and 6A.

Figures 8A, 8B:
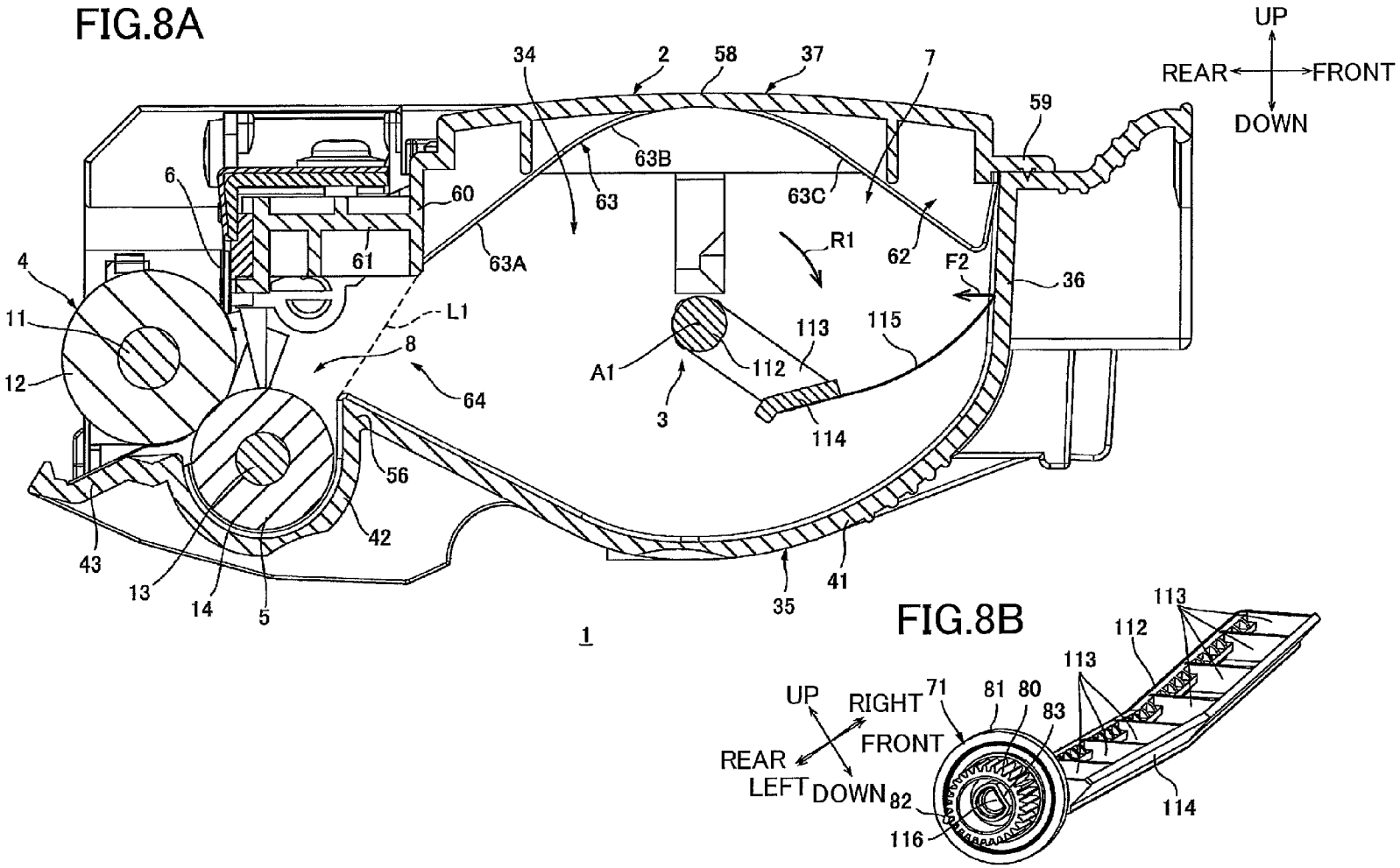
FIG. 8A is a center cross-sectional view of the developing cartridge shown in FIG. 7.
FIG. 8B is a perspective view of the agitator shown in FIG. 8A and the agitator gear as viewed from left-front side.

When the agitator 3 rotates 90 degrees in the rotational direction R1, the radially outer end portion of the agitation blade 115 slides over the curved portion 63B and the second slant portion 63C of the contact recessed portion 63, and then, reaches the rear surface of the front wall 36 as shown in FIGS. 6A and 8A.

The radial outer end portion of the agitation blade 115 presses the front wall 36 toward radially outward as shown in FIG. 8A. The agitation blade 115 is pressed rearward due to a reaction force F2 generated in response to the pressing by the agitation blade 115. The agitator shaft 112 is thus pressed rearward through the agitation blade 115, blade fixing portion 114 and coupling plates 113.

As a result, the agitator shaft 112 resiliently deforms such that the left-right center portion of the agitator shaft 112 is bent toward rearward as shown in FIG. 8B. The gear attachment portion 116 and agitator gear 71 are thus caused to move frontward while rotating in the rotational direction R1, as shown in FIG. 7. At this time, the center axis A1 of the agitator shaft 112 is positioned frontward of the first imaginary line I1 and upward of the second imaginary line I2. Incidentally, in this state, the second gear portion 80 of the agitator gear 71 is still spaced apart from the downstream end portion of the detection gear portion 88 and the upstream end portion of the detection abutment portion 89 in the rotational direction R2.

Figures 10A, 10B:
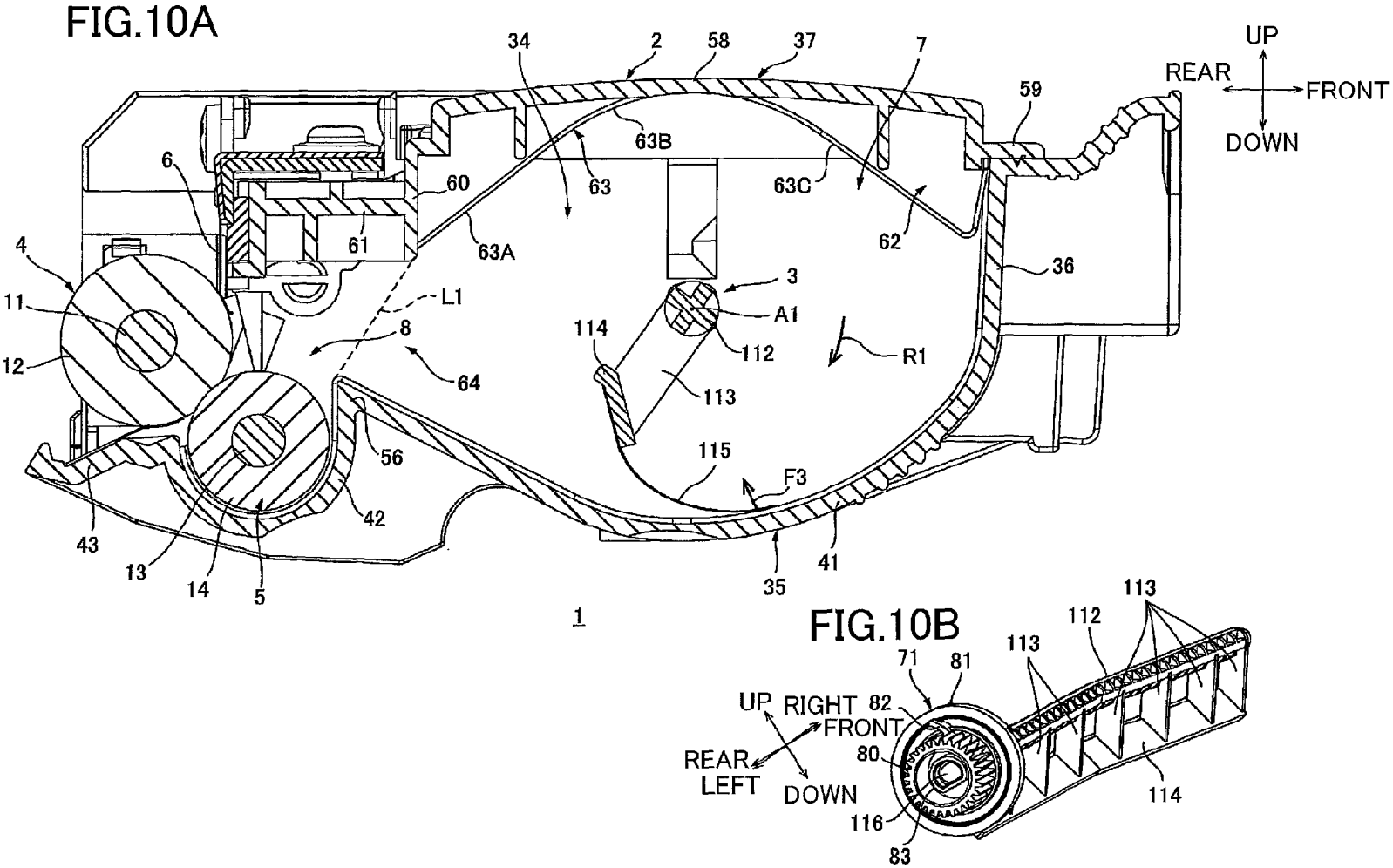
FIG. 10A is a center cross-sectional view of the developing cartridge shown in FIG. 9.
FIG. 10B a perspective view of the agitator shown in FIG. 10A and the agitator gear as viewed from left-front side.

Subsequently, as the agitator 3 further rotates in the rotational direction R1 by substantially 90 degrees, the radially outer end portion of the agitation blade 115 slidingly moves against the rear surface of the front wall 36 and reaches the upper surface of the curved portion 41, as shown in FIGS. 8A and 10A.

At this time, the radially outer end portion of the agitation blade 115 presses the curved portion 41 toward radially outward, as shown in FIG. 10A. The agitation blade 115 is pressed rearward and upward due to a reaction force F3 generated in response to the pressing of the agitation blade 115. The agitator shaft 112 is thereby pressed rearward and upward via the agitation blade 115, blade fixing portion 114 and coupling plates 113, as shown in FIG. 10B.

The agitator shaft 112 is thus caused to resiliently deform such that the left-right center portion of the agitator shaft 112 is bent rearward and upward. The gear attachment portion 116 and agitator gear 71 are thereby caused to move downward while rotating in the rotational direction R1, as shown in FIG. 9. At this time, the center axis A1 of the agitator shaft 112 is positioned frontward of the first imaginary line I1 and downward of the second imaginary line I2.

Subsequently, as the agitator 3 further rotates in the rotational direction R1 by substantially 90 degrees, the radially outer end portion of the agitation blade 115 slidingly moves against the upper surface of the curved portion 41 and then arrives at the communication hole 64 as shown in FIGS. 10A and 12A.

Here, the radial outer end portion of the agitation blade 115 is no longer in sliding contact with the curved portion 41 and is spaced away from the curved portion 41. As a result, due to the resiliency of the agitation blade 115, the agitation blade 115 restores its original shape and functions to supply toner within the toner accommodating chamber 7 toward the developing chamber 8 through the communication hole 64.

At this time, since the agitation blade 115 is spaced away from the curved portion 41 and thus no longer presses the agitator shaft 112, due to the resiliency of the agitator shaft 112, the agitator shaft 112 restores the original shape thereof (extending in the leftward/rightward direction as shown in FIG. 12B) from the resiliently deformed state. Accordingly, the gear attachment portion 116 and agitator gear 71 are caused to move rearward and upward while rotating in the rotational direction R1, as shown in FIG. 11. The center axis A1 of the agitator shaft 112 becomes coincident with each of the first imaginary line I1 and second imaginary line I2.

In the meantime, that is, while the agitation blade 115 is being spaced apart from the housing 2, the abutment plate 82 moves in accordance with the rotation of the agitator gear 71, passes through the notched portion 99 of the detection gear portion 88 of the detection gear 72, and then abuts on the upstream end portion of the detection abutment portion 89 of the detection gear 72 in the rotational direction R2. The abutment plate 82 thus presses the upstream end portion of the detection abutment portion 89 of the detection gear 72 frontward and downward.

Due to the pressing by the abutment plate 82, the detection gear 72 is caused to rotate in the rotational direction R2 to move from the initial position to a drive force transmission position as an example of a second position. When the detection gear 72 is at the drive-force transmission position, as shown in FIG. 11, the downstream end portion of the detection gear portion 88 in the rotational direction R2 is intermeshed with the front end portion of the second gear portion 80. The detection gear 72 is therefore caused to rotate in the rotational direction R2 upon receipt of the drive force from the agitator gear 71. In other words, while the agitation blade 115 is being spaced apart from the housing 2, the agitator gear 71 is brought into meshingly engagement with the detection gear 72 at the drive force transmission position, and transmits the drive force to the detection gear 72.

Figure 13B:
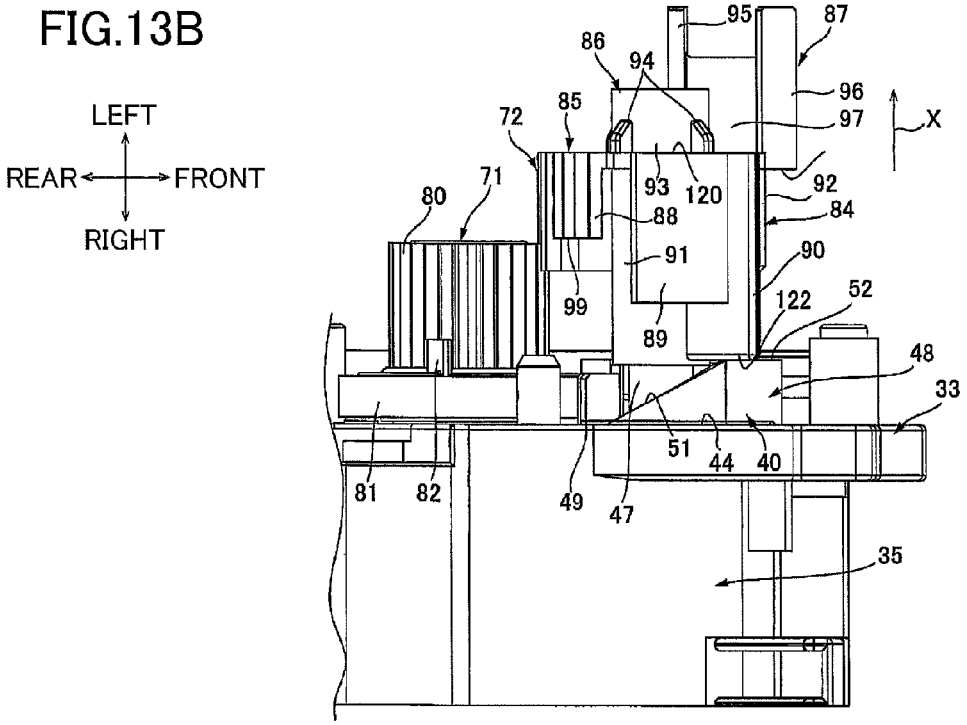
FIG. 13B is a bottom view of the detection gear and the agitator gear shown in FIG. 13A.

In accordance with the rotation of the detection gear 72, the slide portion 122 of the guide rib 90 of the detection gear 72 moves in the rotational direction R2 as shown in FIGS. 13A and 13B, slidingly moves on and along the first sloped surface 51 of the guide portion 48, and reaches the first parallel surface 52.

The detection gear 72 thereby gradually advances leftward along the detection gear support shaft 47 against the biasing force of the spring member 100 to reach an advanced position that is its furthest position from the left side wall 33 (most leftward position).

At this time, although not shown in the drawings, the left end portions of the first detected protrusion 95 and second detected protrusion 96 respectively protrude, through the detected portion insertion opening 109 of the second cover 102, further leftward relative to the left end face of the circumferential wall 106. The left end portion of the first detected protrusion 95 is positioned frontward and downward of the abutment lever 192 of the actuator 191 at the non-detection position and is spaced apart therefrom. Note that the coupling portion 97 is positioned rightward of the left end face of the circumferential wall 106 and is disposed within the circumferential wall 106.

Then as the detection gear 72 at the advanced position further rotates in the rotational direction R2, the slide portion 122 of the guide rib 90 moves in the rotational direction R2 while making sliding contact with the first parallel surface 52 and the first detected protrusion 95 moves in the rotational direction R2 as shown in FIG. 13A.

The left end portion of the first detected protrusion 95 is brought into abutment contact with the lower-front end portion of the abutment lever 192 from its front side. As a result, the actuator 191 at the non-detection position is caused to pivotally move clockwise in a left side view to move to the detection position. At this time, the light shielding lever 195 moves clockwise in a left side view and is retracted from the path of light emitted from the light emitting element to the light receiving element of the optical sensor 194. The optical sensor 194 therefore detects that the actuator 191 is moved from the non-detection position to the detection position and outputs the ON signal. The detection mechanism 190 thus detects the first detected protrusion 95.

As the detection gear 72 further rotates, the first detected protrusion 95 separates from the abutment lever 192 and the left end portion of the second detected protrusion 96 is then brought into abutment contact with the lower-front end portion of the abutment lever 192 from its front side.

The actuator 191 is thereby caused to pivotally move, which causes the actuator 191 to move from the detection position, to the non-detection position and then back to the detection position again. In the meantime, when the optical sensor 194 detects the pivotal movement of the actuator 191 from the detection position to the non-detection position, the optical sensor 194 switches the ON signal to the OFF signal, and when the optical sensor 194 then detects the pivotal movement of the actuator 191 from the non-detection position to the detection position, the optical sensor 194 outputs the ON signal again.

Figure 14B:
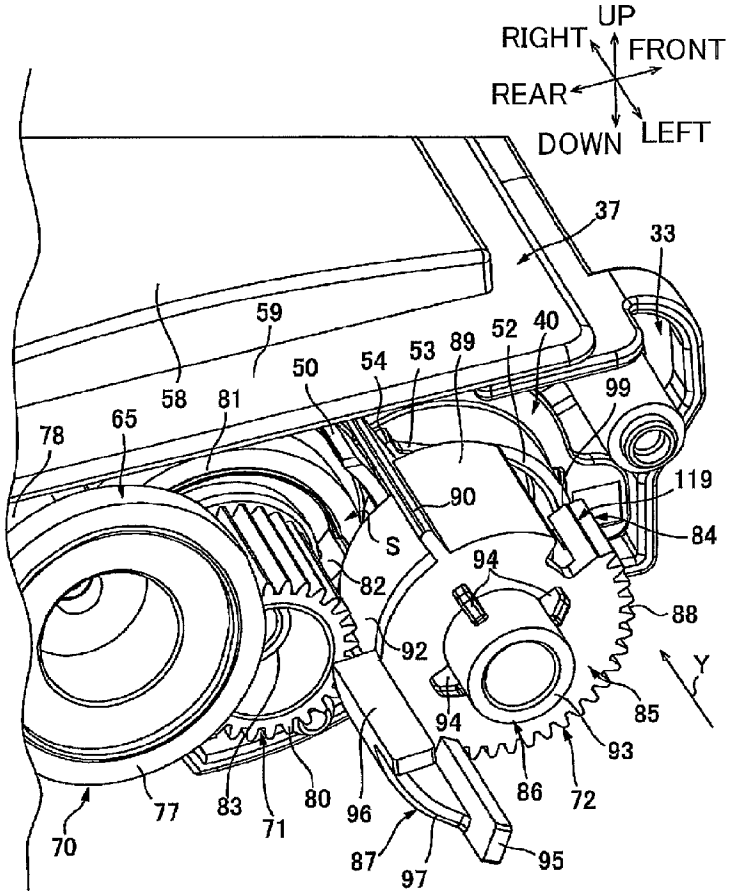
FIG. 14B is a perspective view as viewed from left-upper side of the detection gear and the agitator gear shown in FIG. 14A.
Figure 14A:
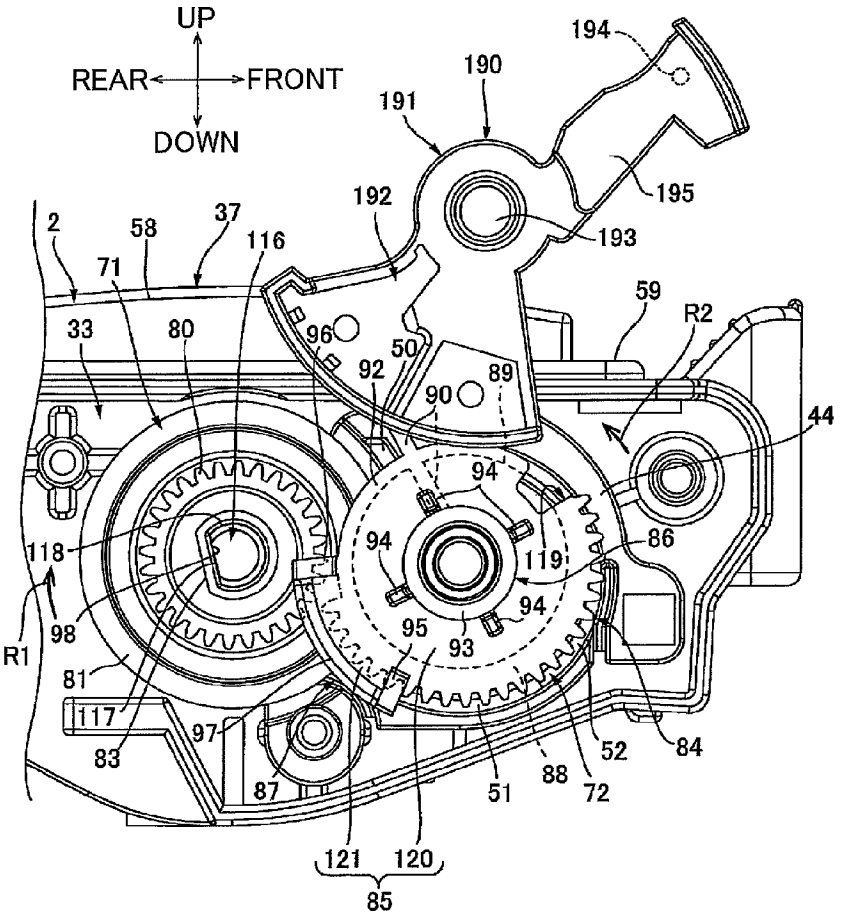
FIG. 14A is an explanatory diagram illustrating the new product detecting operation performed subsequent to the operation illustrated in FIG. 13A, in which the detection gear is in a terminal position.

Subsequently, as the detection gear 72 further rotates, the second detected protrusion 96 is separated from the abutment lever 192 as shown in FIG. 14A. The actuator 191 thus returns to the non-detection position from the detection position. Accordingly, the optical sensor 194 detects that the actuator 191 pivotally moves from the detection position to the non-detection position, and switches the ON signal to the OFF signal.

As the detection gear 72 further rotates, the slide portion 122 of the guide rib 90 arrives at the second sloped surface 53 from the first parallel surface 52, as shown in FIG. 14B. Hence, in accordance with the rotation of the detection gear 72, the slide portion 122 of the guide rib 90 is caused to move gradually toward rightward due to the biasing force of the spring member 100 while making sliding contact with the second sloped surface 53. When the slide portion 122 of the guide rib 90 reaches the junction between the second sloped surface 53 and notched surface 54, the detection gear 72 moves quickly rightward due to the biasing force of the spring member 100 until the slide portion 122 of the guide rib 90 abuts on the second parallel surface 55. The first detected protrusion 95 and second detected protrusion 96 are therefore caused to move rightward and accommodated within the circumferential wall 106, as shown in FIG. 1.

At this time, as shown in FIG. 14A, the detection gear portion 88 of the detection gear 72 are disengaged from the second gear portion 80 of the agitator gear 71, thereby halting rotation of the detection gear 72. The detection gear 72 is thus in the terminal position and ends rotation.

If the agitator gear 71 rotates when the detection gear 72 is at the terminal position, the abutment plate 82 passes through a gap S formed between the connecting portion 92 and first gear portion 81 in the leftward/rightward direction, as shown in FIG. 14B.

When the detection gear 72 is at the terminal position, the rightward portion of the guide rib 90 is positioned between the second stop 50 and notched surface 54 in the rotational direction R2. With this structure, the detection gear 72 is maintained at the terminal position and remains motionless irrespective of the rotation of the agitator gear 71.

As described above, when a new developing cartridge 1 is mounted in the main casing 16 for the first time, the optical sensor 194 outputs the ON signal twice. Accordingly, if the optical sensor 194 outputs the ON signal twice after the developing cartridge 1 is mounted in the main casing 16, the microcomputer (not shown) determines that the mounted developing cartridge 1 is a new product.

On the other hand, if an old developing cartridge 1, i.e., a developing cartridge 1 that has been previously mounted in the main casing 16, is mounted in the main casing 16, the detection gear 72 remains motionless even if the agitator gear 71 rotates, since the detection gear 72 is at the terminal position.

Therefore, if the optical sensor 194 does not output the ON signal within a prescribed period of time after the developing cartridge 1 is mounted in the main casing 16, the microcomputer (not shown) determines that the mounted developing cartridge 1 has been used once.

(3) Operations for Removing the Developing Cartridge from the Main Casing

As described above, the detection gear 72 is disposed in its terminal position when the developing cartridge 1 is used. At this time, the first detected protrusion 95 and second detected protrusion 96 are accommodated within the circumferential wall 106.

In order to remove the used developing cartridge 1 from the main casing 16, the operator performs the operations for mounting the developing cartridge 1 described above in reverse. Specifically, the operator opens the front cover 21, as shown in FIG. 2, and pulls the developing cartridge 1 forward and out of the main casing 16. This completes the operations for removing the developing cartridge 1 from the main casing 16.

6. Operations and Technical Advantages (1) According to the developing cartridge 1, the rotation of the agitator gear 71 causes the abutment plate 82 to contact the detection abutment portion 89 of the detection gear 72 at the initial position, thereby moving the detection gear 72 from the initial position to the drive-force transmission position. The second gear portion 80 of the agitator gear 71 meshingly engages the detection gear portion 88 of the detection gear 72 at the drive-force transmission position, transmitting the drive force to the detection gear 72.

In other words, by contacting the abutment plate 82 with the detection abutment portion 89 of the detection gear 72 positioned at the initial position, the detection gear portion 88 of the detection gear 72 can be meshingly engaged with the second gear portion 80 of the agitator gear 71 at a desired timing.

As shown in FIGS. 11 and 12A, the agitation blade 115 is being spaced apart from the housing 2 at the time when the second gear portion 80 of the agitator gear 71 is brought into meshingly engagement with the detection gear portion 88 of the detection gear 72 which is positioned at the drive force transmitting position.

Therefore, when the second gear portion 80 is brought into engagement with the detection gear portion 88, the reaction force that was generated in response to the contact of the agitation blade 115 with the housing 2 and exerted on the agitator shaft 112 has already disappeared. This ensures that the agitator shaft 112 is not resiliently deformed at the time when the second gear portion 80 of the agitator gear 71 is brought into engagement with the detection gear portion 88 of the detection gear 72 positioned at the drive force transmitting position. This ensures a stable engagement of the agitator gear 71 with the detection gear 72.

This ensures that a driving force is transmitted from the agitator gear 71 to the detection gear 72 and therefore that the detected portion 87 is detected by the detection mechanism 190. Further, this contributes to improvements in the detection accuracy for the information of the developing cartridge 1.

(2) Additionally, the agitator shaft 112 has the gear attachment portion 116 as shown in FIG. 11. The agitation blade 115 and agitator gear 71 can be positioned relative to each other by using the gear attachment portion 116 of the agitator shaft 112 as the positioning reference.

This improves as shown in FIG. 12A the accuracy in positioning the agitation blade 115 and the abutment plate 82 of the agitator gear 71 relative to each other in the rotational direction R1. This ensures that the detection gear portion 88 of the detection gear 72 is brought into engagement with the second gear portion 80 of the agitator gear 71 while the agitation blade 115 is being apart from the housing 2 as shown in FIGS. 11 and 12A.

(3) As shown in FIG. 11, the gear attachment portion 116 has a substantially D-shape when viewed in the leftward/rightward direction. The agitator gear 71 is attached to the gear attachment portion 116.

Therefore, it is ensured that the agitator gear 71 and the agitator shaft 112 are rotated integrally with each other. As a result, it is possible to maintain unchanged the relative positions between the agitation blade 115 and the agitator gear 71 during rotation of the agitator 3 as shown in FIG. 12A. This can improve accuracy in positioning the agitation blade 115 and the abutment plate 82 relative to each other in the rotational direction R1.

(4) As shown in FIGS. 11 and 12A, the agitation blade 115 is disposed within the angular range of 180 degrees in the rotational range of 360 degrees of the agitator 3 in the rotational direction R1.

Therefore, this ensures that the agitation blade 115 is being spaced apart from the housing 2 at the time when the second gear portion 80 of the agitator gear 71 is brought into engagement with the detection gear portion 88 of the detection gear 72 which is positioned at the drive force transmitting position as shown in FIG. 11.

(5) It is noted that if the agitator shaft 112 deforms during rotation of the agitator 3, the agitator gear 71 is decentered such that the second gear portion 80 is decentered to a degree greater than the first gear portion 81 because the second gear portion 80 is disposed further away from the left side wall 33 than the first gear portion 81 is from the left side wall 33. However, according to the present embodiment, as shown in FIGS. 11 and 12A, while the agitation blade 115 is being spaced away from the housing 2, the second gear portion 80 of the agitator gear 71 is brought into engagement with the detection gear 72. This ensures reliable contact between the second gear portion 80 of the agitator gear 71 and the detection gear 72.

(6) It is conceivable to provide the cover member 66 with an additional member for restricting the agitator gear 71 from being decentered during rotation of the agitator 3. However, this will increase the number of components provided in the developing cartridge 1 and increase the size of the developing cartridge 1 accordingly. Contrarily, according to the present embodiment, the agitator gear 71 is spaced away from the cover plate 103 of the second cover 102 in the leftward/rightward direction, as shown in FIG. 4A. Further, while the agitation blade 115 is being spaced apart from the housing 2, the second gear portion 80 of the agitator gear 71 is brought into engagement with the detection gear portion 88 of the detection gear 72 as shown in FIGS. 11 and 12A.

Therefore, the agitator gear 71 can be reliably engaged with the detection gear 72 even though no additional member is provided to the second cover 102 for restricting the agitator gear 71 from being decentered.

This configuration can ensure that the agitator gear 71 is brought into contact with the detection gear 72, while decreasing the number of components in the developing cartridge 1 and downsizing the developing cartridge 1.

(7) When the detection gear 72 is positioned at the initial position, the second gear portion 80 of the agitator gear 71 faces the slit 119 in the frontward/rearward direction, as shown in FIG. 5.

This ensures that the detection gear portion 88 of the detection gear 72 positioned at the initial position is reliably prevented from being engaged with the second gear portion 80 of the agitator gear 71, and that the detection gear 72 positioned at the initial position is prevented from starting to rotate at an undesired timing.

On the other hand, when the detection gear 72 is positioned at the drive force transmitting position, the second gear portion 80 of the agitator gear 71 is meshingly engaged with the detection gear portion 88, as shown in FIG. 11. This ensures that the driving force is transmitted to the detection gear 72 positioned at the drive force transmitting position, thereby rotating the detection gear 72.

7. Second Embodiment

A second embodiment of the present invention will be described below.

Figure 15:
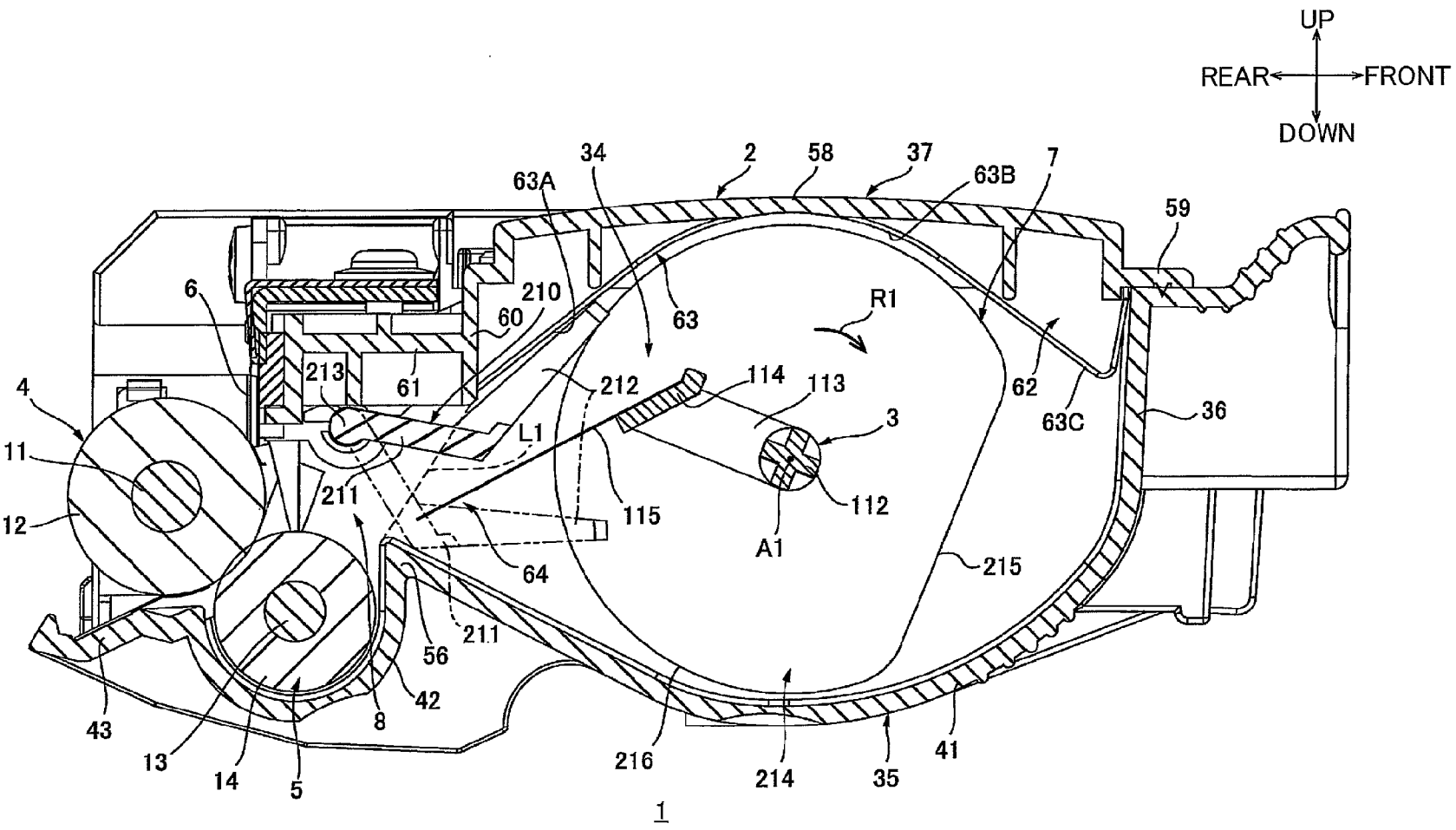
FIG. 15 is a center cross-sectional view showing a developing cartridge in accordance with a second embodiment of the invention.

In FIG. 15, elements corresponding to those shown in FIGS. 1-14B are labeled with the identical reference numbers, and explanation of these elements will be omitted.

In the second embodiment, the developing cartridge 1 has a shutter 210 provided at the boundary between the toner accommodating chamber 7 and the developing chamber 8 for restricting movement of toner.

The shutter 210 has a pivot shaft 213, a shutter body 211, and a cam contact portion 212. The shutter 210 is pivotable about the pivot shaft 213 between the closed position at which the shutter body 211 closes the communication hole 64 and the open position at which the shutter body 211 opens the communication hole 64.

The following description of the shutter 210 will be based on a state of the shutter 210 in its open position. In FIG. 15, the shutter 210 in the open position is indicated with a solid line. The shutter 210 in the closed position is indicated with an imaginary line.

The pivot shaft 213 has substantially a columnar shape extending in the leftward/rightward direction, and is positioned above the supply roller 5 in the developing chamber 8. The pivot shaft 213 has both ends rotatably supported to the right side wall 34 and the left side wall 33.

The shutter body 211 extends forward and downward from the front part of the peripheral surface of the pivot shaft 213. Further, the shutter body 211 has a plate shape in a plan view.

The cam contact portion 212 extends forward and upward from the radially outer end portion of the shutter body 211 at the right edge thereof.

The shutter 210 is constantly urged to the closed position by a spring member (not shown).

The agitator 3 has a cam 214 for opening or closing the shutter 210.

The cam 214 is disposed at the right end of the agitator shaft 112, facing the cam contact portion 212. The cam 214 has a substantially D shape in a side view and spreads radially outward from the peripheral surface of the agitator shaft 112. The cam 214 is positioned with its rotational center being coincident with the central axis A1 of the agitator shaft 112.

The peripheral surface of the cam 214 has a linear portion 215 and a circumferential portion 216.

The linear portion 215 constitutes a chord corresponding to an arc portion having the central angle of about 45 degrees within the peripheral surface of the cam 214. The linear portion 215 is positioned opposite to the blade fixing portion 114 with respect to the agitator shaft 112 when viewed in the leftward/rightward direction.

The circumferential portion 216 is a portion of the peripheral surface of the cam 214 excluding the linear portion 215. The circumferential portion 216 has an arc shape having the central angle of about 315 degrees.

During the rotation of the agitator 3, when the circumferential portion 216 is brought into contact with the cam contact portion 212, the cam 214 moves the shutter 210 to the open position. When the linear portion 215 faces the cam contact portion 212 with a gap formed therebetween, the cam 214 allows the shutter 210 to move to the closed position. Therefore, the shutter 210 is moved between the open position and the closed position in interlocking relation with the rotation of the agitator 3.

According to the second embodiment, when viewed in the leftward/rightward direction, the abutment plate 82 is disposed upstream of the blade fixing portion 114 in the rotational direction R1 with an angular interval of approximately 160 degrees formed therebetween.

During rotation of the agitator 3, when the radially outer end portion of the agitation blade 115 moves past the communication hole 64, the circumferential portion 216 of the cam 214 is in contact with the cam contact portion 212 of the shutter 210. So, the shutter 210 is disposed at the open position when the radially outer end portion of the agitation blade 115 moves past the communication hole 64.

This ensures that the agitator 3 conveys toner agitated in the toner accommodation chamber 7 into the developing chamber 8 via the communication hole 64.

In other words, the shutter 210 can restrict toner from moving from the toner accommodation chamber 7 into the developing chamber 8 at undesired timings, while allowing toner to move from the toner accommodation chamber 7 into the developing chamber 8 when the agitation blade 115 moves past the communication hole 64 in accordance with rotation of the agitator 3.

During rotation of the agitator 3, while the radially outer end portion of the agitation blade 115 is moving past the communication hole 64 and is being spaced apart from the shutter 210, the second gear portion 80 of the agitator gear 71 is brought into engagement with the detection gear portion 88 of the detection gear 72 which is at the drive force transmission position as shown in FIGS. 11 and 15.

This ensures stable engagement of the second gear portion 80 of the agitator gear 71 with the detection gear portion 88 of the detection gear 72 at the drive force transmission position.

With the construction according to the second embodiment, the same operational advantages as those described above in the first embodiment can be achieved.

8. Variations and Modifications (1) In the first and second embodiments described above, the optical sensor (not shown) is configured to output an OFF signal when detecting that the actuator 191 has pivoted from the detection position to the non-detection position, but the optical sensor may be configured to halt output of its ON signal instead.

(2) In the first and second embodiments described above, the developing cartridge 1 can be mounted in or removed from the drum cartridge 24. However, the developing cartridge 1 may also be integrally configured with the drum cartridge 24, for example. In this case, the process cartridge 17 integrally provided with the developing cartridge 1 and the drum cartridge 24 corresponds to an example of the cartridge.

(3) The developing cartridge 1 may also be configured to have a toner box for accommodating toner such that the toner box can be mounted on or removed from a frame retaining the developing roller 4. In this case, the toner box includes the agitator 3 and the detection unit 32 and is an example of the cartridge. Or, the toner box alone may be configured to be mountable in and removable from the main casing 16 retaining the developing roller 4 and the photosensitive drum 25.

Alternatively, the developing cartridge 1 alone may be configured to be mountable in and removable from the main casing 16 retaining the photosensitive drum 25.

(4) In the first and second embodiments described above, the detection gear 72 is formed of a well-known plastic and is integrally provided with the first detected protrusion 95 and the second detected protrusion 96. However, the first detected protrusion 95 and the second detected protrusion 96 may be provided as separate members on the detection gear 72. In this case, each of the first detected protrusion 95 and the second detected protrusion 96 may be formed of a resin film or an elastic member, such as rubber.

Figure 16:
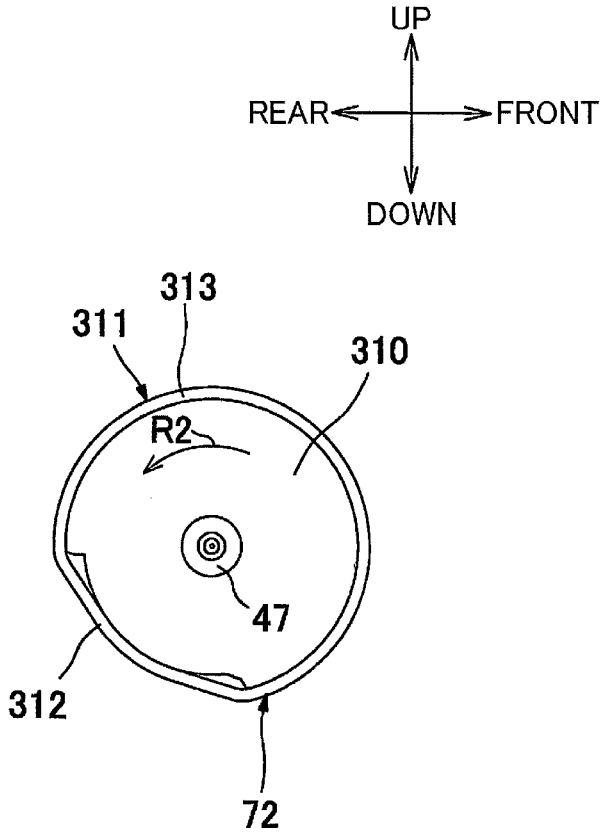
FIG. 16 is a left side view showing a plate-like portion and a resistance applying member used in a modification of the embodiments.

(5) In the first and second embodiments, the detection gear 72 has the detection gear portion 88. Instead, as shown in FIG. 16, the detection gear 72 may have a plate-like portion 310 and a resistance applying member 311 in place of the detection gear portion 88.

The plate-like portion 310 is disposed rightward of and adjacent to the main portion 120 of the plate-like portion 85. The plate-like portion 310 has a fan-like shape that is centered on the center of the main portion 120. The resistance applying member 311 is formed of a material having a relatively high coefficient of friction, such as rubber, and is wound around an outer peripheral surface of the plate-like portion 310. Owing to the shape of the plate-like portion 310, the outer peripheral surface formed by the resistance applying member 311 includes a lacking portion 312 that is recessed inward in a radial direction of the plate-like portion 310, and a contact portion 313 constituting a portion of the outer peripheral surface excluding the lacking portion 312. The plate-like portion 310 and resistance applying member 311 are formed of a size and shape that enable the contact portion 313 to contact the second gear portion 80 of the agitator gear 71 while preventing the lacking portion 312 from contacting the second gear portion 80. In this example, gear teeth may be provided or not provided around the circumferential surface of the second gear portion 80.

When the detection gear 72 is at the initial position, the lacking portion 312 is positioned frontward of the second gear portion 80 with a gap formed therebetween. When the detection gear 72 is at the drive force transmission position, the contact portion 313 contacts the second gear portion 80 from its front side. This configuration can transmit drive force inputted into the development coupling 67 to the detection gear 72 through the gear train 65. When the detection gear 72 reaches the terminal position, the lacking portion 312 separates away from the second gear portion 80 forwardly. Therefore, the detection gear 72 stops rotating when the detection gear 72 is at the terminal position.

(6) In the first and second embodiments described above, the detection gear 72 is rotatably supported on the cap 40, and the cap 40 is mounted on the left side wall 33. However, the detection gear 72 may be directly supported by the housing 2. In this case, the housing 2 possesses the detection gear support portion 45.

(7) In the first and second embodiments described above, the detection gear 72 is configured to move in the leftward/rightward direction while rotating from the initial position toward the terminal position. Instead, the detection gear 72 may be configured to rotate without moving with respect to the leftward/rightward direction.

(8) In the first and second embodiments described above, the agitator 3 is arranged in a new developing cartridge 1 such that the flat surface 117 of the gear attachment portion 116 faces upward and extends in the frontward/rearward direction as shown in FIG. 5. With this configuration, the coupling plates 113, blade fixing portion 114, and agitation blade 115 are disposed above the agitator shaft 112, and the radially outer end portion of the agitation blade 115 is in contact with the curved portion 63B of the contact portion 62.

However, the agitator 3 may not be arranged in the new developing cartridge 1 in the manner described above. The agitator 3 may be disposed at other angular positions depending on timings when the abutment plate 82 and detection abutment portion 89 are desired to be brought into abutment contact with each other, that is, on timings when the second gear portion 80 and detection gear portion 88 are desired to be brought into engagement with each other.

(9) In the first and second embodiments described above, the gear attachment portion 116 has an approximately D shape in a side view. However, the shape of the gear attachment portion 116 is not limited to this shape, but may have any shape that can restrain the agitator gear 71 from rotating relative to the gear attachment portion 116. For example, the gear attachment portion 116 may have a T shape or an isosceles triangular shape in a side view.

With the constructions according to these variations and modifications, the same operational advantages as those described above in the first and second embodiments can be achieved.

Incidentally, the depicted configurations according to the first and second embodiments, variations and modifications can also be combined appropriately depending on intended purposes and usage.

While the invention has been described in detail with reference to the embodiments and modifications thereof, it would be apparent to those skilled in the art that various changes and modifications may be made therein without departing from the scope of the invention.

What is claimed is:

1. A cartridge comprising:

a housing configured to accommodate developer therein;

an agitator positioned in the housing and rotatable relative to the housing about an axis defining an axial direction;

a first rotary member having a detected portion and a first abutment portion and rotatable relative to the housing; and a second rotary member rotatable relative to the housing and having a second abutment portion abuttable on the first abutment portion, the second rotary member being configured to transmit a driving force to the first rotary member, the first rotary member being configured to move from a first position spaced apart from the second rotary member to a second position contacting the second rotary member to receive the driving force from the second rotary member, the agitator comprising:

a rotation shaft extending in the axial direction and having an axial end portion at which the second rotary member is supported; and an agitation blade supported to the rotation shaft and resiliently deformable, the agitation blade being in contact with and spaced away from the housing in accordance with the rotation of the rotation shaft, and the second rotary member being configured such that while the agitation blade is spaced apart from the housing, the second abutment portion contacts the first abutment portion in accordance with rotation of the second rotary member to move the first rotary member from the first position to the second position, thereby transmitting the driving force from the second rotary member to the first rotary member.

2. The cartridge as claimed in claim 1, wherein the rotation shaft has a reference portion that is a reference for relative positioning between the agitation blade and the second rotary member in a rotational direction of the agitator.

3. The cartridge as claimed in claim 2, wherein the reference portion is positioned at the end portion of the rotation shaft in the axial direction, and has a generally D-shape, when viewed in the axial direction, in which a peripheral surface of the rotation shaft is partially cut away, the second rotary member being attached to the reference portion.

4. The cartridge as claimed in claim 1, wherein the agitation blade is disposed within an angular range of 180 degrees in a rotational range of 360 degrees of the agitator.

5. The cartridge as claimed in claim 1, wherein the housing has a wall portion at which the first rotary member and the second rotary member are provided, and wherein the second rotary member comprises a first gear portion and a second gear portion, the first gear portion and the second gear position arrayed in the axial direction, the second gear portion being positioned farther away from the wall portion than the first gear portion from the wall portion, and the second gear portion being in contact with the first rotary member to transmit the driving force to the first rotary member.

6. The cartridge as claimed in claim 1, further comprising a cover member covering the first rotary member and the second rotary member, the cover member being spaced apart from the second rotary member in the axial direction.

7. The cartridge as claimed in claim 1, further comprising a shutter disposed in the housing and configured to restrict movement of the developer, wherein the housing comprises:

a first accommodating chamber configured to accommodate therein the developer, and in which the agitator is disposed;

a second accommodating chamber positioned adjacent to the first accommodating chamber; and an opening portion providing communication between the first accommodating chamber and the second accommodating chamber, wherein the shutter is configured to move between an open position opening the opening portion and a closed position closing the opening portion in interlocking relation with the rotation of the agitator such that the shutter is at the open position when the agitation blade is moved past the opening portion, and the second rotary member being configured such that the second rotary member is brought into contact with the first rotary member while the agitation blade is moving past the opening portion and is spaced apart from the shutter.

8. The cartridge as claimed in claim 1, wherein the second rotary member comprises a gear wheel, and wherein the first rotary member comprises:

a gear teeth portion configured to engage the gear wheel to receive the driving force when the first rotary member is at the second position; and a tooth lacking portion configured to face the second rotary member when the first rotary member is at the first position to avoid engagement with the gear wheel.

* * * * *